US005478720A

United States Patent [19]

Heki

[11] Patent Number: 5,478,720

[45] Date of Patent: Dec. 26, 1995

[54] SILVER HALIDE PHOTOGRAPHIC EMULSION AND SILVER HALIDE PHOTOGRAPHIC LIGHT-SENSITIVE MATERIAL

[75] Inventor: Katsuhiko Heki, Hino, Japan

[73] Assignee: Konica Corporation, Japan

[21] Appl. No.: 218,770

[22] Filed: Mar. 28, 1994

[30] Foreign Application Priority Data

Apr. 1, 1993 [JP] Japan ..... 5-075832

[51] Int. Cl.[6] ..... G03C 1/16; G03C 1/18; G03C 1/29

[52] U.S. Cl. ..... 430/574; 430/572; 430/576; 430/583; 430/585

[58] Field of Search ..... 430/572, 574, 430/576, 577, 585, 583

[56] References Cited

U.S. PATENT DOCUMENTS

| | | | |
|---|---|---|---|
| T969,006 | 4/1978 | Mihari et al. | 430/576 |
| 2,316,268 | 4/1943 | Mareis | 430/576 |
| 3,718,475 | 2/1973 | Shiba et al. | 430/574 |
| 3,772,033 | 11/1973 | Ficken et al. | 430/576 |
| 3,885,972 | 5/1975 | Moisar et al. | 430/576 |
| 3,953,215 | 4/1970 | Hinata et al. | 430/574 |
| 3,969,116 | 7/1976 | Shiba et al. | 430/572 |
| 3,977,883 | 8/1976 | Hinata et al. | 430/574 |
| 5,166,046 | 11/1992 | Okusa et al. | 430/576 |
| 5,185,237 | 2/1993 | Kawai | 430/576 |

FOREIGN PATENT DOCUMENTS

| | | | |
|---|---|---|---|
| 110697 | 6/1940 | Australia | 430/576 |
| 471003 | 1/1951 | Canada | 430/576 |
| 1405083 | 8/1964 | France | 430/574 |
| 43-4933 | 2/1968 | Japan | 430/574 |
| 0010423 | 1/1978 | Japan | 430/576 |
| 1230449 | 5/1971 | United Kingdom | 430/576 |
| 1310994 | 3/1973 | United Kingdom | 430/576 |
| 1317036 | 5/1973 | United Kingdom | 430/576 |
| 1333170 | 10/1973 | United Kingdom | 430/576 |

*Primary Examiner*—Lee C. Wright
*Attorney, Agent, or Firm*—Jordan B. Bierman; Bierman and Muserlian

[57] ABSTRACT

A silver halide photographic emulsion is provided, containing a monomethine-cyanine dye, a trimethine-cyanine dye and a supersensitizer represented by the following Formula [I] or Formula [II]. The cyanine dyes are incorporated in the form of a dispersion of solid particles.

Formula [I]

Formula [II]

13 Claims, 1 Drawing Sheet

SILVER HALIDE PHOTOGRAPHIC EMULSION AND SILVER HALIDE PHOTOGRAPHIC LIGHT-SENSITIVE MATERIAL

FIELD OF THE INVENTION

The present invention relates to a silver halide emulsion and a silver halide photographic light-sensitive material, and more particularly to a silver halide emulsion and a silver halide photographic light-sensitive material having excellent color reproducibility, desirable latent image storage stability, high speed and low fogging property.

BACKGROUND OF THE INVENTION

One of the important characteristics of a silver halide photographic light-sensitive material is storage stability. Of them, stability for a period from exposure to development, in other words latent image storage stability is important.

When a silver halide is subjected to exposure to light, latent image is formed. The latent image is so unstable that it is faded or intensified with the passage of time. From the viewpoint of photographic performance, it results in the reduction or increase of speed.

The above-mentioned latent image storage stability is greatly affected by the preparation method structure, surface treatment, methods for chemical sensitization and spectral sensitization of a silver halide, characteristics of binders including gelatin, kinds of hardeners, pH and silver ion concentration of the coating solution.

As a method for enhancing latent image storage stability (hereinafter referred also to latent image stability), various methods have been proposed so far.

For example, Japanese Patent Publication Open to Public Inspection (hereinafter referred to as Japanese Patent O.P.I. Publication) No. 291250/1989 discloses a method to use benzthiazolium, Japanese Patent O.P.I. Publication No. 17431/1983 discloses a method to use pyrogallol derivatives, Japanese Patent O.P.I. Publication No. 152235/1983 discloses a method to use tetrazaindenes and Japanese Patent O.P.I. Publication No. 257947/1989 discloses a method to control tabular grains and pH in the layer surface.

However, regardless of using the above-mentioned technologies, the degree of the improvement of latent image stability is insufficient and reduction of speed and enhancement of fogging follow and furthermore technology improvement has been demanded.

In addition, when green color wavelength region is spectrally sensitized in a color negative film, an oxacarbocyanine dye, an imidacarbocyanine dye and an oxathiacarbocyanine dye are used independently or 2 or more of them are used in combination.

However, when a light-sensitive material is subjected to spectral sensitization using the above-mentioned sensitizing dye, there was a shortcoming that spectral sensitivity in the short wavelength side of the green wavelength region was low though the long side of the green wavelength region was enhanced.

As technology to enhance spectral sensitivity of the short wavelength side of the green wavelength region, methods to use a monomethine cyanine dye and a trimethinecyanine dye in combination are disclosed in Japanese Patent O.P.I. Publication Nos. 362933/1992 and 170535/1992 and Japanese Patent Publication Nos. 34535/1979 and 38936/1981, a method to use an asymmetrical pseudouric cyanine dye in combination with a trimethine cyanine dye or a monomethine cyanine dye disclosed in Japanese Patent O.P.I. Publication No. 352150/1992.

When the above-mentioned technologies are used, spectral sensitivity of the short wavelength side of the green wavelength region can be enhanced. However, the reduction of sensitivity in the overall green wavelength length is caused and the latent image stability is noticeably deteriorated. Accordingly, further improvement in technologies has been demanded.

SUMMARY OF THE INVENTION

An object of the present invention is to provide a silver halide photographic light-sensitive material having high speed, low fog, desirable latent image storage stability and excellent color reproduction in bluish green wherein shorter wavelength side of the green wavelength region is spectrally sensitized highly.

The above-mentioned object of the present invention is attained by either of the following constitutions (1) through (2).

(1) A silver halide photographic emulsion containing a monomethinecyanine dye, a trimethinecyanine dye and a supersensitizer, respectively.

(2) The silver halide photographic emulsion described in (1) above, wherein aforesaid supersensitizer is represented by the following Formula [I] or [II].

Formula [I]

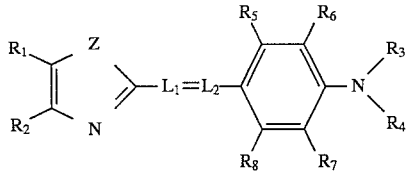

wherein $R_1$, $R_2$, $R_3$ and $R_4$ independently represent a hydrogen atom, an alkyl group, an alkenyl group, an alkynyl group, an aryl group or a heterocyclic group; and $R_5$, $R_6$, $R_7$ and $R_8$ represent substituents.

$L_1$ and $L_2$ represent a methine group; Z represents a hydrogen atom, a sulfur atom, a selenium atom, a tellurium atom, $>C(R_9)(R_{10})$ or $>N\text{-}R_9$. $R_9$ and $R_{10}$ independently represent a hydrogen atom, an alkyl group, an alkenyl group, an alkynyl group, an aryl group or a heterocyclic group; and $R_1$ and $R_2$, $R_3$ and $R_4$, and $R_9$ and $R_{10}$ can respectively form rings.

Formula [II]

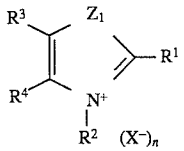

wherein $R^1$, $R^2$, $R^3$ and $R^4$ independently represent a hydrogen atom, an alkyl group, an alkenyl group, an alkynyl group, an aryl group or a heterocyclic group, and $R^3$ and $R^4$ may be combined with each other to form a ring; $Z_1$ represents —O—, —S—, —Se—, —Te—,—$C(R^5)(R^6)$— or —$N(R^5)$— in which $R^5$, $R^6$ and $R^7$ each have the same definition as $R^1$; $X^-$ is an anion; and n is 0 or 1.

(3) The silver halide photographic emulsion described in (1) above, wherein a monomethinecyanine dyes and a trimethinecyanine dye are added into the silver halide photographic emulsion in the form of solid particles.

(4) A silver halide photographic light-sensitive material comprising a silver halide emulsion containing a monomethinecyanine dye, a trimethinecyanine dye and a supersensitizer, respectively.

(5) The silver halide photographic light-sensitive material described in (4) above, wherein the supersensitizer is represented by Formula [I].

(6) The silver halide photographic light-sensitive material comprising the silver halide photographic emulsion described in (1) above, wherein a monomethinecyanine dyes and a trimethinecyanine dye are added into the silver halide photographic emulsion in the form of solid particles.

BRIEF DESCRIPTION OF THE DRAWINGS

FIG. 1(*b*) is a perspective view of an impeller. 1: Tank, 2: Dissolver, 3: Vertical axis, 4: Solution to be dispersed, 5: Impeller, 6 and 7: Fan

DETAILED DESCRIPTION OF THE INVENTION

Figure 1:
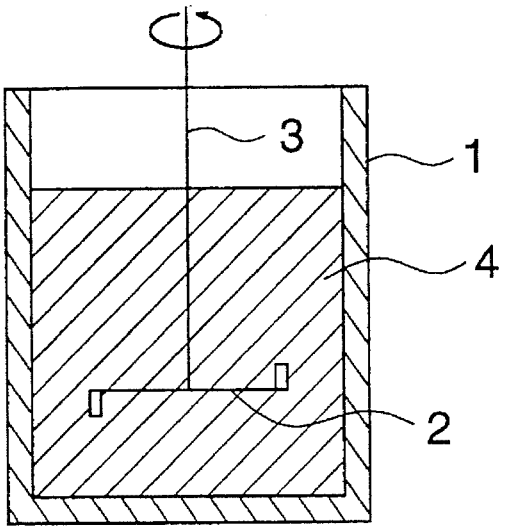
FIG. 1(*a*) is a schematic view of a high-speed stirring type homogenizer.
Figure 1:
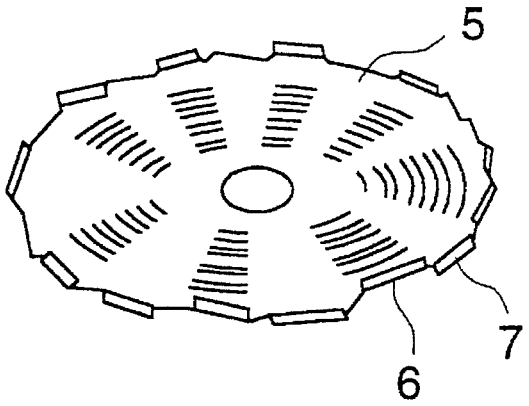

In the present invention, as monomethine cyanine dyes and trimethine cyanine dyes, sensitizing dyes represented by the following Formula [S-I] are preferably used.

Formula [S-I]

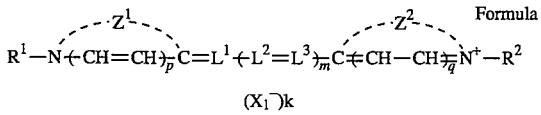

wherein $Z^1$ and $Z^2$ respectively represent a group of non-metallic atoms necessary for forming a 5-membered or 6-membered heterocyclic ring, provided that they may be the same or different; $R^1$ and $R^2$, which may be the same or different, independently represent an alkyl group or a substituted alkyl group; $L^1$, $L^2$ and $L^3$ independently represent a methine group or a substituted methine group; p and q independently represent 0 or 1; m represents 0 or 1; $X_1^{-1}$ represents an anion and k represents 0 or 1. Thus, when m is 0, the formula represents a monomethine-cyanine dye and when m is 1, the formula represents a trimethine-cyanine dye.

The sensitizing dyes represented by the above-mentioned Formula [S-I] are the sensitizing dyes described in Japanese Patent O.P.I. publication No. 54547/1991. Examples of the dyes are described as follows.

S-1

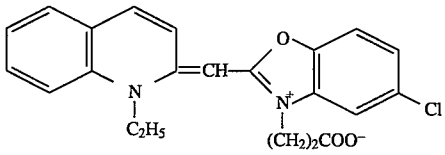

S-2

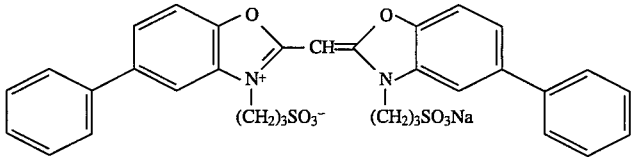

S-3

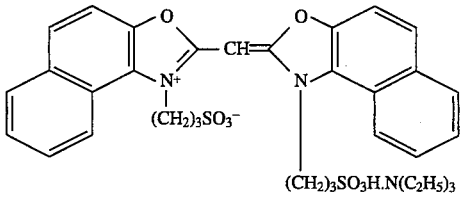

S-4

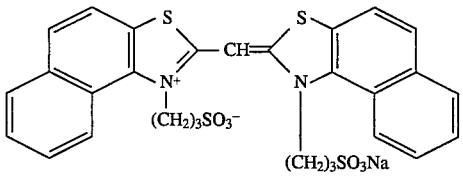

-continued
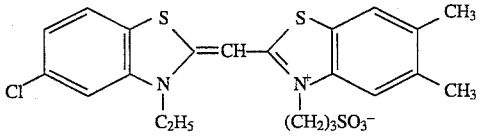
S-5
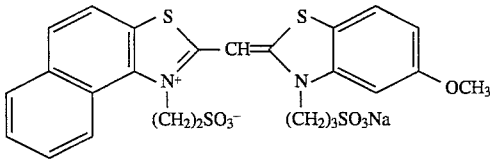
S-6
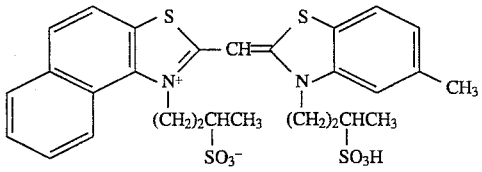
S-7
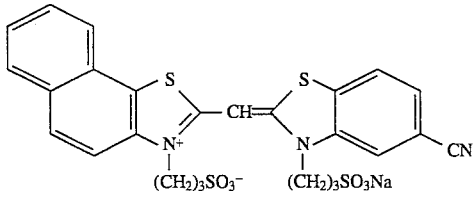
S-8
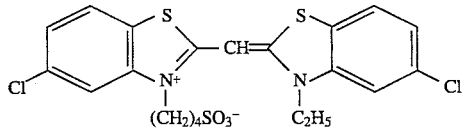
S-9
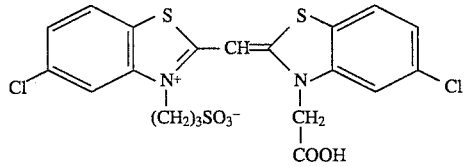
S-10
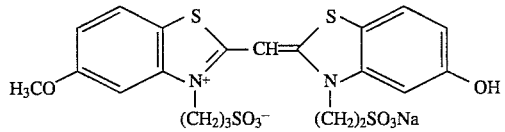
S-11
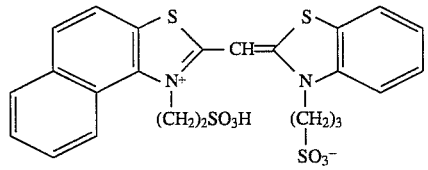
S-12
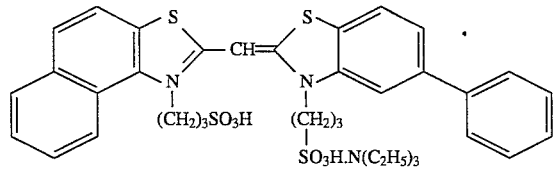
S-13
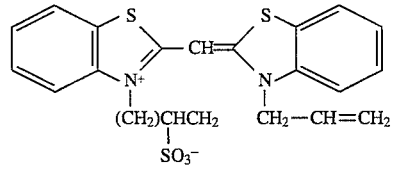
S-14

-continued
S-15
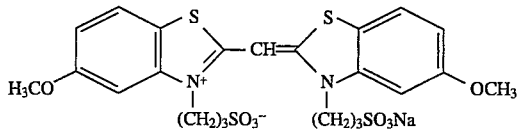
S-16
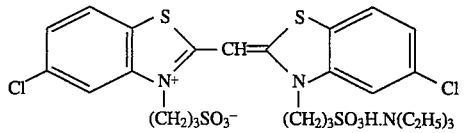
S-17
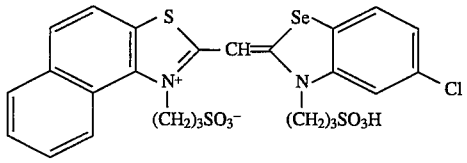
S-18
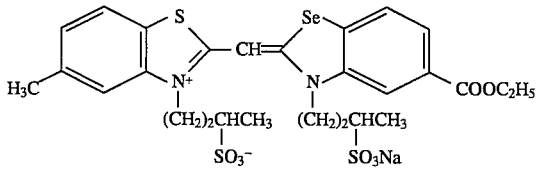
S-19
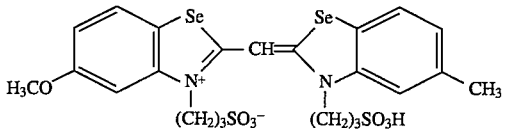
S-20
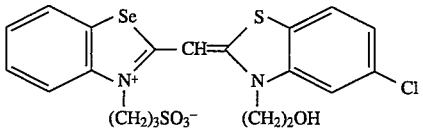
S-21
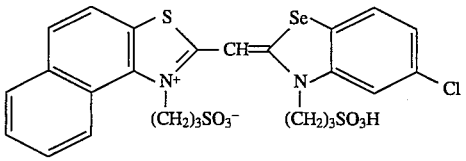
S-22
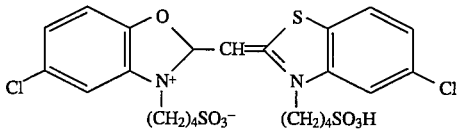
S-23
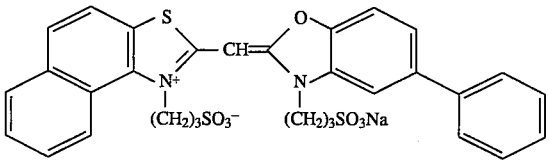
S-24
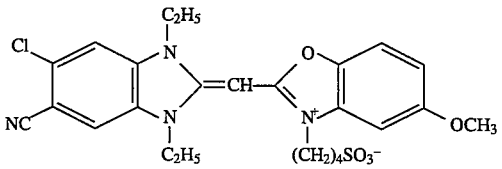

-continued
S-25
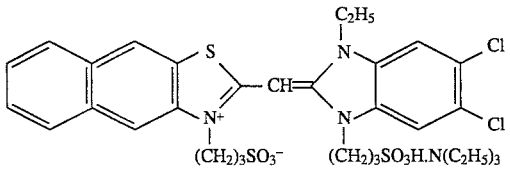
S-26
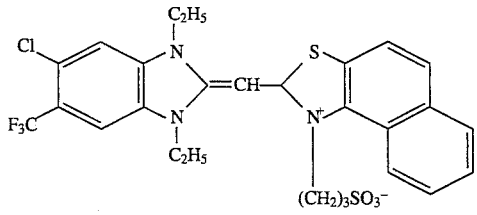
S-27
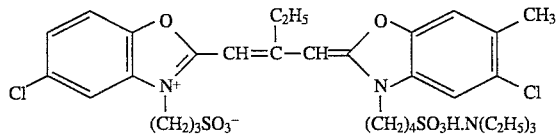
S-28
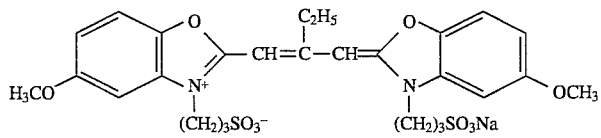
S-29
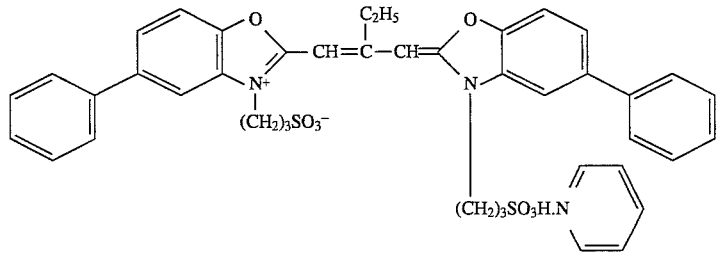
S-30
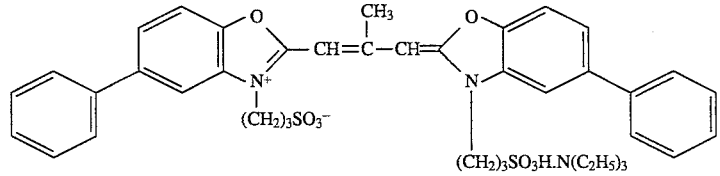
S-31
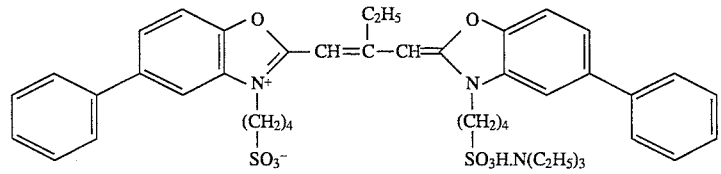
S-32
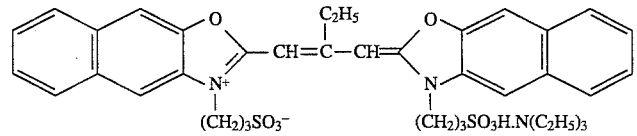
S-33
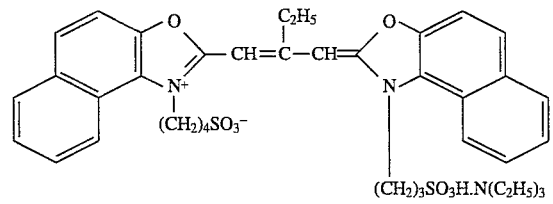

-continued
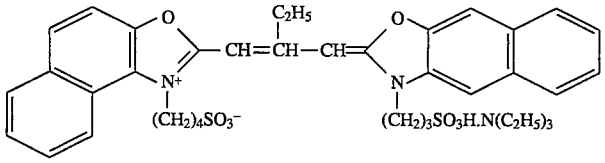
S-34
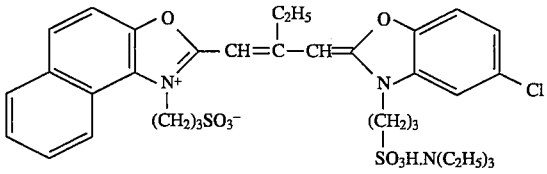
S-35
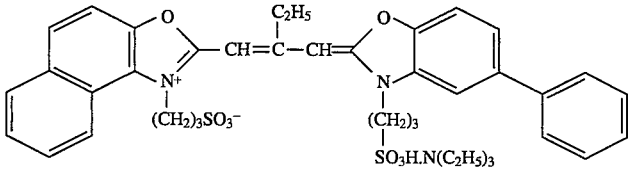
S-36
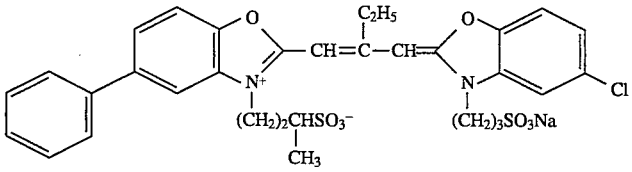
S-37
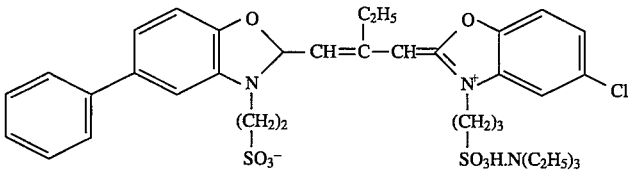
S-38
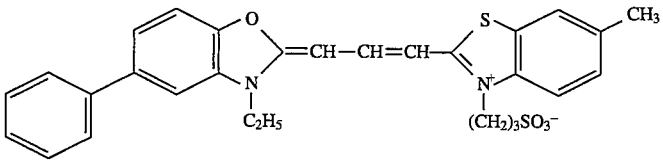
S-39
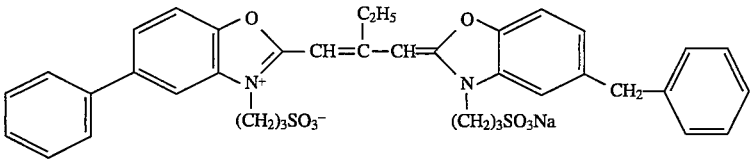
S-40
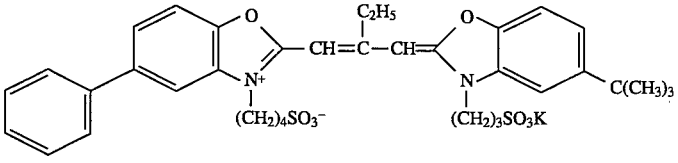
S-41
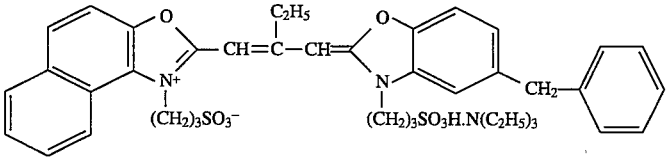
S-42

-continued
S-43
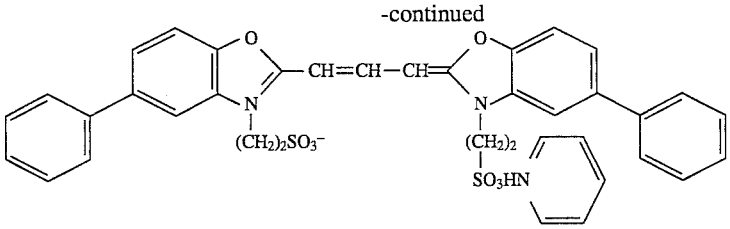
S-44
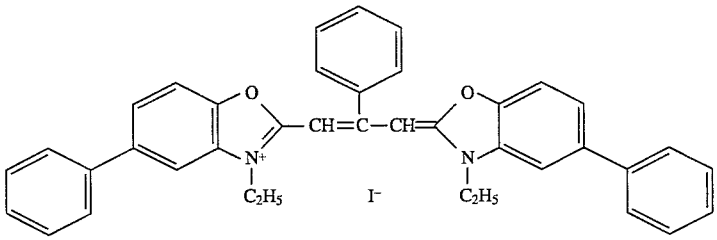
S-45
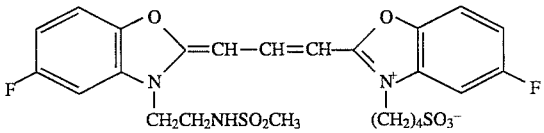
S-46
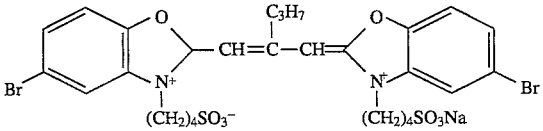
S-47
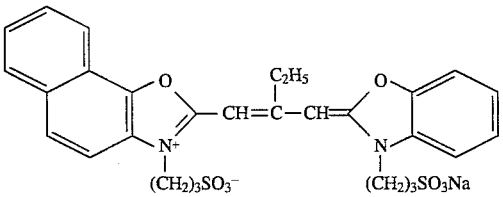
S-48
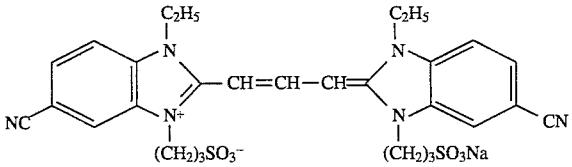
S-49
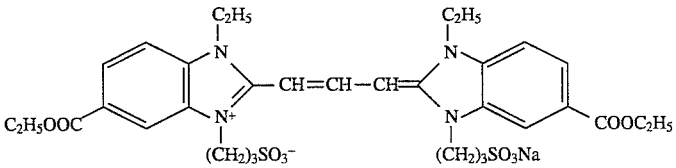
S-50
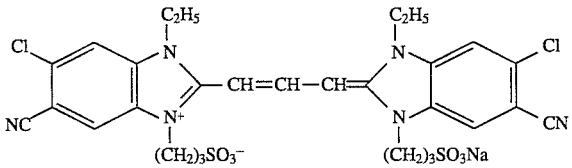
S-51
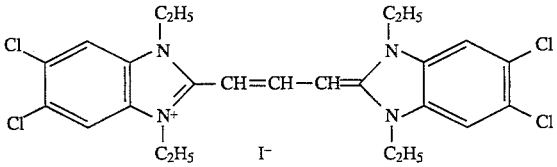

-continued
S-52
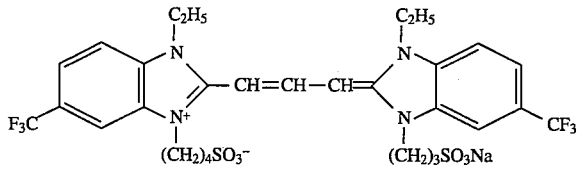
S-53
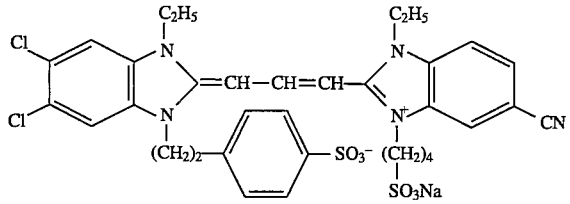
S-54
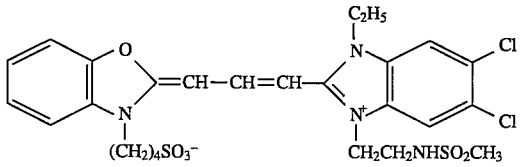
S-55
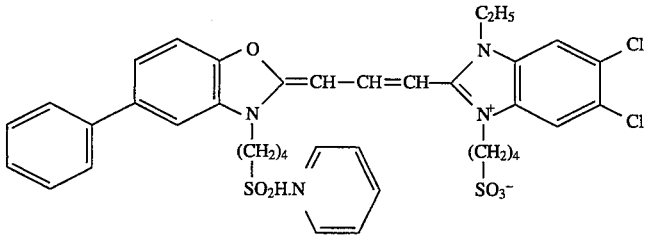
S-56
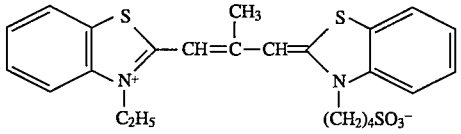
S-57
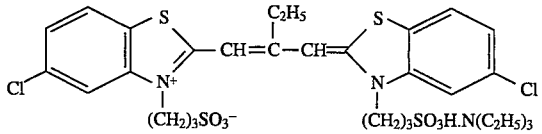
S-58
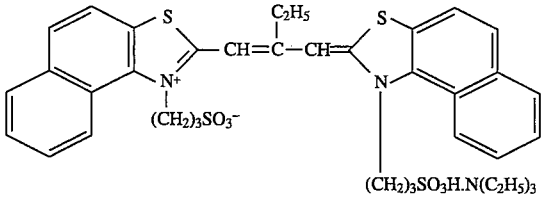
S-59
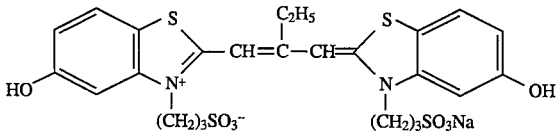
S-60
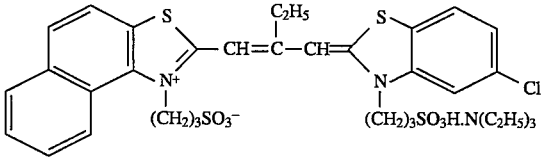

-continued
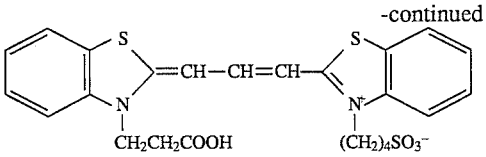
S-61
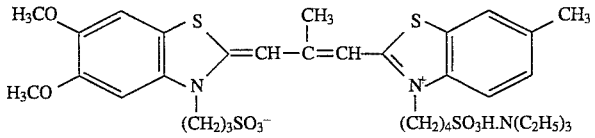
S-62
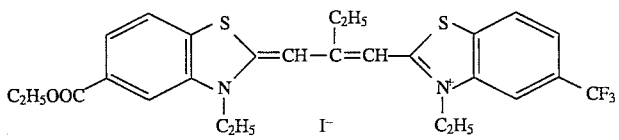
S-63
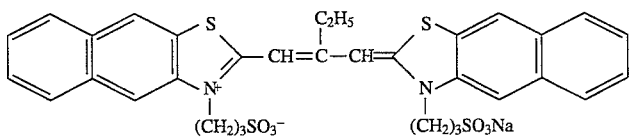
S-64
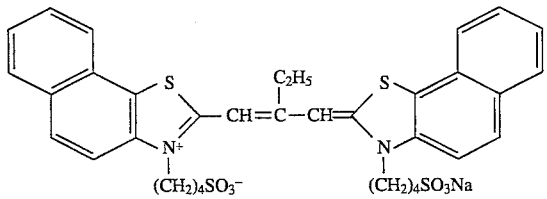
S-65
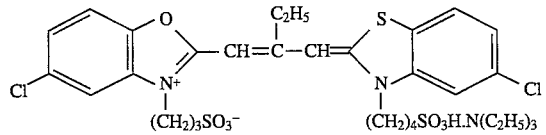
S-66
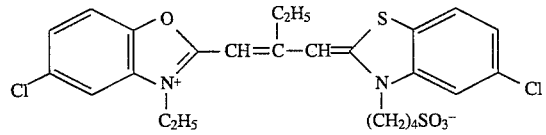
S-67
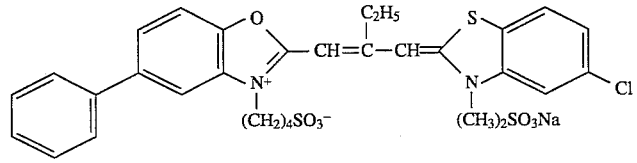
S-68
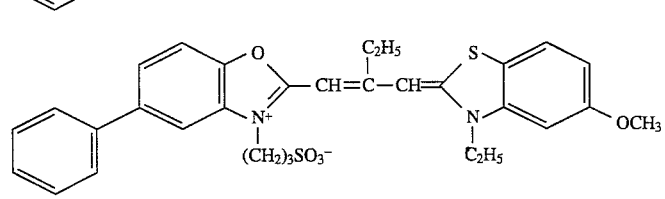
S-69
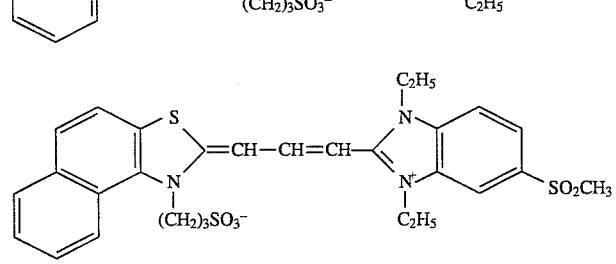
S-70

-continued

S-71

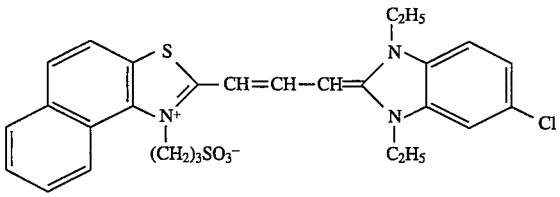

S-72

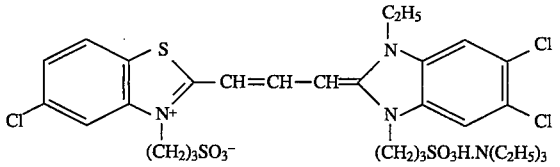

S-73

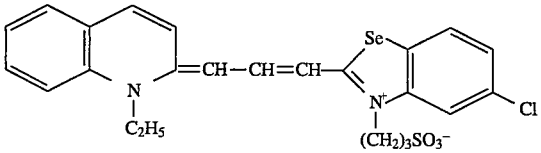

In the present invention, the total of the addition amount of the monomethine cyanine dye and the trimethine cyanine dye is preferably $1\times10^{-5}$ to $1\times10^{-2}$ mol and more preferably $5\times10^{-5}$ to $5\times10^{-3}$ mol per mol of silver halide. The ratio of the addition amount of the monomethine cyanine dye to that of the trimethine cyanine dye in terms of mol is preferably 1:50 to 50:1 and more preferably 1:20 to 20:1 and especially more preferably 1:10 to 10:1.

In the present invention, the monomethine cyanine dye and the trimethine cyanine dye may be added to the silver halide emulsion simultaneously or separately.

In the present invention, 2 or more kinds of monomethine cyanine dyes or 2 or more kinds of trimethine cyanine dyes may be used in combination. In addition, 2 or more monomethine cyanine dyes and 2 or more trimethine cyanine dyes may be used concurrently.

In the present invention, the monomethine cyanine dye and the trimethine cyanine dye are added by conventionally-known methods. For example, a method by dissolving a dye in a appropriate solvent (methanol, ethanol, propanol, fluorinated alcohol, 1-methoxyethanol, water and aqueous acidic or alkaline solution having suitable pH) and adding to an emulsion in a form of solution, a method disclosed in U.S. Pat. No. 3,469,987, wherein a dye dissolved in a volatile organic solvent is dispersed in a hydrophilic colloid and the resulting dispersion is added to an emulsion and a method disclosed in Japanese Patent Publication No. 24185/1971 wherein a dye insoluble in water is dispersed in an aqueous solvent and the resulting dispersion is added to an emulsion are well-known in the art.

In the present invention, it is preferred that the monomethine cyanine dye and the trimethine cyanine dye be added to the silver halide emulsion in the form of solid particles. For adding the monomethine cyanine dye and the trimethine cyanine dye in the solid particle form, they are added to the emulsion in a granular or powder form, or in the form of dispersion of solid particles dispersed in a liquid medium.

In the present invention, it is a preferable that are dispersed the monomethine cyanine dye and the trimethine cyanine in water a substantially not containing an organic solvent and added to an emulsion in the form of dispersion of solid particles.

In order to disperse a sensitizing dye in water in the form of dispersion substantially not containing an organic solvent, various dispersion methods are effectively used. Practically, a high-speed stirrer, a ball mill, a sand mill, a colloid mill, an atriter and a ultrasonic homogenizer are used. In the present invention, a high speed stirrer is preferable.

In the present invention, an organic solvent is referred to as a carbon atom-containing solvent which is liquid at room temperature. Heretofore, as a solvent for a sensitizing dye, water-miscible organic solvents including alcohols, ketones, nitriles and alkoxy alcohols have been used. Practically, methanol, ethanol, propyl alcohol, i-propyl alcohol, ethylene glycol, propylene glycol, 1,3-propane diol, acetone, acetonitrile, 2-methoxyethanol and 2-ethoxyethanol are cited.

In the present invention, the above-mentioned organic solvents are substantially not contained.

In the present invention, "substantially not containing" means that the proportion of the above-mentioned organic solvent to water is ordinarily 10% or less, preferably 5% or less and especially preferably 3% or less.

A high-speed stirrer type homogenizer includes, as shown in FIG. 1(*a*), one composed of tank 1, dissolver 2 and vertical axis 3. FIG. 1(*b*) shows dissolver 2.

A high-speed stirrer type homogenizer may be one having a dissolver equipped with a multiple impeller on the vertical shaft and a multi-shaft dissolver provided with multiple vertical shaft. In addition, a high-speed stirrer type homogenizer having an anchor wing other than a dissolver singly. Practical procedure is as follows. After water is added to a tank wherein temperature can be regulated, a prescribed amount of spectral sensitizing dye powder is added thereto. By means of a high-speed stirrer, the mixture is stirred for a given time, crushed and dispersed while the temperature is controlled. There is no limitation for pH and the temperature when the spectrally sensitizing dye is mechanically dispersed. However, there are problems that desired particle size cannot be attained after a long time of dispersion at low temperature, desired photographic performance cannot be attained at high temperature due to the occurrence of re-coagulation and degradation, and crushing and dispersion efficiency of solid particles is remarkably degraded due to the reduction of the viscosity of solution when temperature is enhanced. Accordingly, the temperature for dispersion is preferably 15° to 50° C. In addition, the rotation number of stirring in dispersion is preferably from 1000 to 6000 rpm because lower rotation number requires a long time for obtaining desired grain size and higher rotation number involves bubble and reduces dispersion efficiency.

Dispersion of the present invention is referred to as a suspension solution of a spectrally sensitizing dye. It is preferred that those wherein the weight ratio of sensitizing dye in the suspension solution is 0.2 to 5.0% are used.

The dispersion of the sensitizing dye prepared according to the present invention may be added to a silver halide emulsion directly or added after being diluted suitably, in which water is used for diluting solution.

In the present invention, when a sensitizing dye is dispersed in water, a surfactant can be used. The surfactants include an anionic surfactant, a cationic surfactant, a nonionic surfactant and an amphoteric surfactant.

When a sensitizing dye is dispersed in water, the above-mentioned surfactants may be used. However, it is preferable not to use them.

In the present invention, the monomethine cyanine dye and the trimethine cyanine dye may be dispersed concurrently or dispersed separately.

In the present invention, super sensitization is referred to as that, when other spectral sensitizing dyes or other additives are added in addition to a spectrally sensitizing dye is used for one spectral region, an increase in spectral sensitivity greater than can be explained by additivity of sensitizing effects is attained. A supersensitizer is referred to as an organic compound or an inorganic compound capable of attaining the above-mentioned super sensitization. Mechanism of super sensitization is described in "Review of the Mechanisms of Supersensitization", by Gilman, Photographic Science and Engineering, Volume 18, 1974, pp 418 to 430.

As described in Japanese Patent O.P.I. Publication No. 54547/1991, supersensitizers of the present invention include aromatic acid formaldehyde condensation products (for example, those described in U.S. Pat. No. 3,437,510), cadmium salts, azaindene compounds, aminostylbene compounds substituted with a nitrogen-containing heterocycles (for example, those described in U.S. Pat. Nos. 2,933,390 and 3,635,721) and various dyes containing polymethine dyes containing cyanine, merocyanine, holopolar cyanine, complex cyanine, complex merocyanine, oxonol, hemioxonol, styryl, merostyryl, streptocyanine and pyrylium that are ordinarily used as spectrally sensitizing dyes.

The inventive compound represented by Formula [I] is explained more in detail as below.

Formula [I]

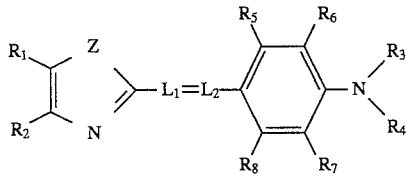

wherein $R_1$, $R_2$, $R_3$ and $R_4$ independently represent a hydrogen atom, an alkyl group, an alkenyl group, an alkynyl group, an aryl group or a heterocyclic group; $R_5$, $R_6$, $R_7$ and $R_8$ independently represent a hydrogen atom or a substituent; $L_1$ and $L_2$ respectively represent a methine group; Z represents an oxygen atom, a sulfur atom, a selenium atom, a tellurium atom, a —$C(R_9)(R_{10})$— or a —$N(R_9)$—. $R_9$ and $R_{10}$ independently represent a hydrogen atom, an alkyl group, an alkenyl group, an alkynyl group, an aryl group or a heterocycle; and $R_1$ and $R_2$, $R_3$ and $R_4$, $R_9$ and $R_{10}$ may be linked together for forming rings.

Furthermore, in detail, in Formula [I], alkyl groups represented by $R_1$, $R_2$, $R_3$ and $R_4$ include methyl, ethyl, propyl, i-propyl, butyl, t-butyl, pentyl, cyclopentyl, hexyl, cyclohexyl, octyl and dodecyl. The alkyl group may be substituted with a halogen atom (for example, fluorine chlorine, bromine and iodine), an alkoxy group (for example, a methoxy group, an ethoxy group, a 1,1-dimethylethoxy group, a hexyloxy group and a dodecyloxy group), an aryloxy group (for example, a phenoxy group and a naphthyloxy group), an aryl group (for example, a phenyl group and a naphthyl group), an alkoxycarbonyl group (for example, methoxycarbonyl, ethoxycarbonyl, buthoxycarbonyl group and a 2-ethylhexylcarbonyl group), an alkenyl group (for example, a vinyl group and an allyl group), a heterocyclic group (for example, a 2-pyridyl group, a 3-pyridyl group, a 4-pyridyl group, a morpholyl group, a pyperidyl group, a pyperadyl group, a pyrimidyl group, a pyrazolyl group and a furyl group), an alkynyl group (for example, a propargyl group), an amino group (for example, an amino group, an N,N-dimethylamino group and an anilino group), a hydroxyl group, a cyano group, a sulfo group, a carboxyl group, a sulfonamide group (for example, a methylsulfonylamino group, an ethylsulfonylamino group, a butylsulfonylamino group, an octylsulfonylamino group and a phenylsulfonylamino group).

As an alkenyl group represented by $R_1$, $R_2$, $R_3$ and $R_4$, a vinyl group and an allyl group are cited.

As an alkynyl group represented by $R_1$, $R_2$, $R_3$ and $R_4$, a propargyl group is cited.

As aryl groups represented by $R_1$, $R_2$, $R_3$ and $R_4$, a phenyl group and a naphthyl group are cited.

As heterocyclic groups represented by $R_1$, $R_2$, $R_3$ and $R_4$, a pyridyl group (for example, a 2-pyridyl group, a 3-pyridyl group and a 4-pyridyl group), a thiazolyl group, an oxazolyl group, an imidazolyl group, a furyl group, a thienyl group, a pyrolyl group, a pyradinyl group, a pyrimidyl group, a pyridadinyl group, a selenazolyl group, a sulforanyl group, a pyperidinyl group, a pyrazolyl group and a tetrazolyl group are cited.

The above-mentioned alkenyl group, alkynyl group, an aryl group and a heterocycle can be substituted with an alkyl group represented by $R_1$, $R_2$ and $R_3$ and with a group shown as a substitute of an alkyl group.

As substituents represented by $R_5$, $R_6$, $R_7$ and $R_8$, an alkyl group, an alkenyl group, an alkynyl group, an aryl group, a heterocyclic group, a halogen atom, an alkoxy group, an aryloxy group, an alkoxycarbonyl group, an aryloxycarbonyl group, a sulfonamide group, a sulfamoyl group, an ureido group, an acyl group, a carbamoyl group, an amide group, a sulfonyl group, an amino group, a cyano group, a nitro group, a carboxyl group, a hydroxyl group and a hydrogen atom are cited. The above-mentioned groups can be substituted with alkyl groups represented by $R_1$, $R_2$ and $R_3$ and with groups shown as substitutes of an alkyl group.

As rings capable of being formed by $R_1$ and $R_2$, a benzene ring, a naphthalene ring, a thiophene ring, a pyridine ring, a furan ring, a pyrimidine ring, a cyclohexane ring, a pyrane ring, a pyrole ring, a pyradine ring and a indole ring are cited.

As rings capable of being formed by $R_3$ and $R_4$, a piperidine ring, a pyrolidine ring, a morphorine ring, a pyrole ring, a pyrazole ring and a piperadine ring are cited.

As rings capable of being formed by $R_9$ and $R_{10}$, a cyclopentane ring and a cyclohexane ring are cited.

The above-mentioned rings can be substituted with alkyl groups represented by $R_1$, $R_2$ and $R_3$ and with groups shown as substitutes of an alkyl group.

The methine groups represented by $L_1$ and $L_2$ may have a substituent. As a substituent, an alkyl group, an aryl group, a halogen atom, an alkoxy group, an aryl oxy group, an alkoxycarbonyl group and an aryloxy carbonyl group are cited.

The above-mentioned groups can be substituted with alkyl groups represented by $R_1$, $R_2$ and $R_3$ and with groups shown as substitutes of an alkyl group.

Hereunder, practical examples of the compounds represented by Formula [I] (hereinafter, referred to as the compound of the present invention) used in the present invention will be cited. However, the present invention is not limited thereto.

I-1

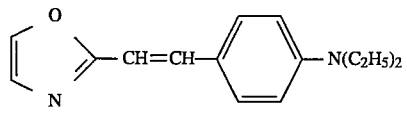

I-2

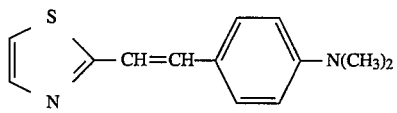

I-3

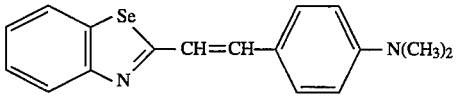

I-4

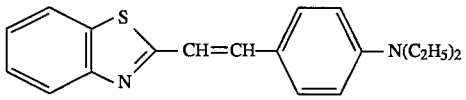

I-5

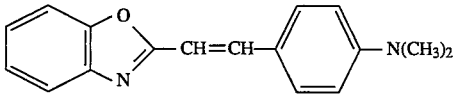

I-6

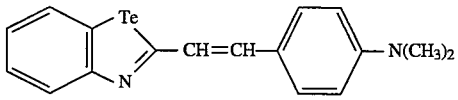

I-7

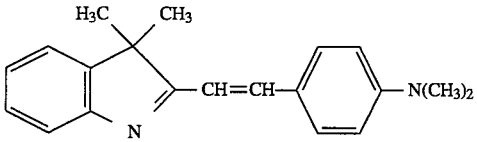

I-8

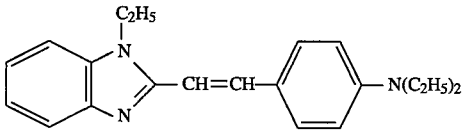

I-9

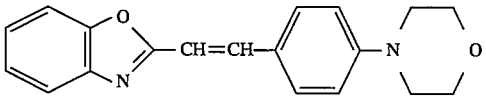

I-10

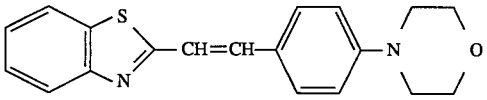

I-11

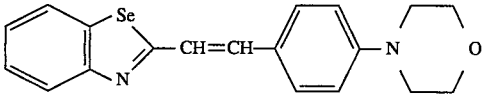

I-12

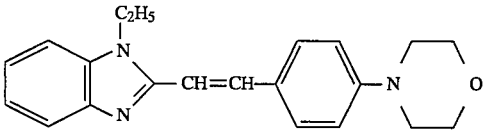

I-13

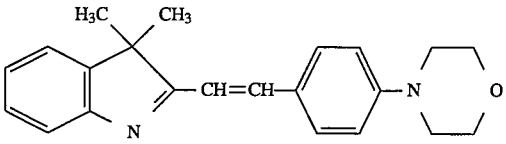

I-14

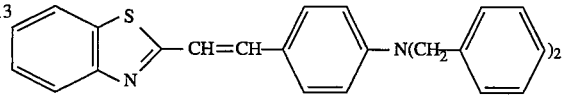

I-15

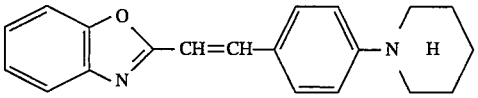

I-16

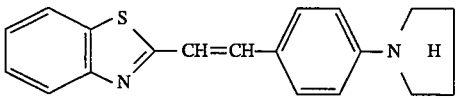

I-17

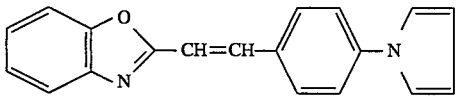

I-18

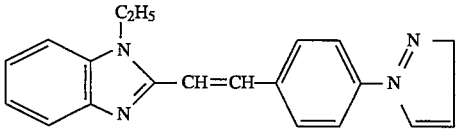

I-19

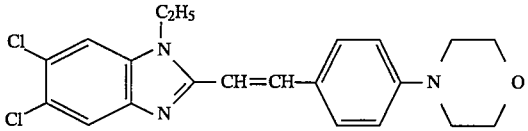

I-20

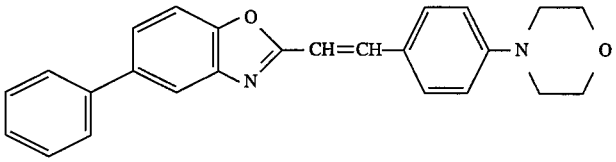

-continued
I-21
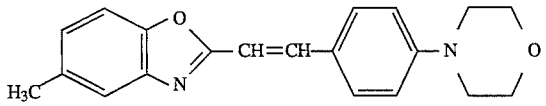
I-22
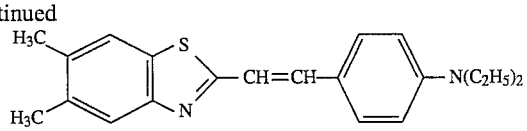
I-23
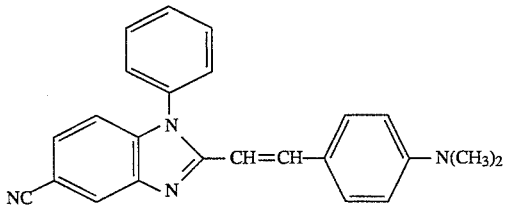
I-24
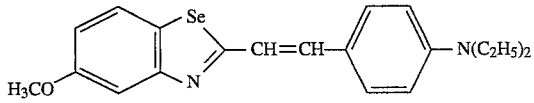
I-25
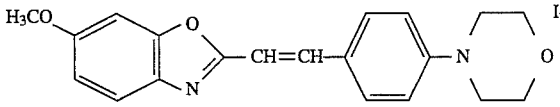
I-26
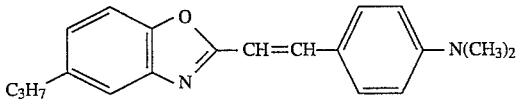
I-27
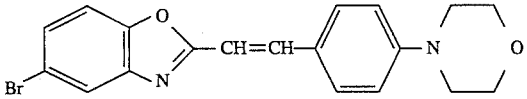
I-28
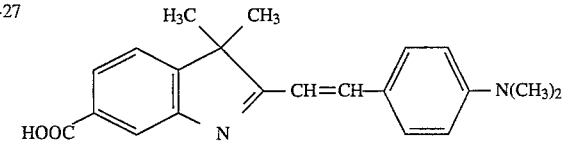
I-29
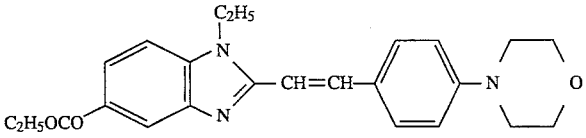
I-30
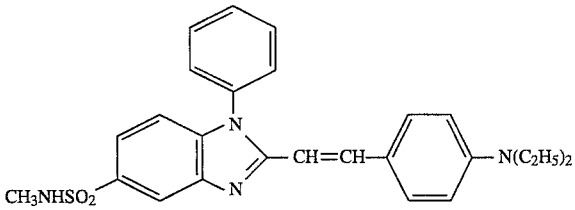
I-31
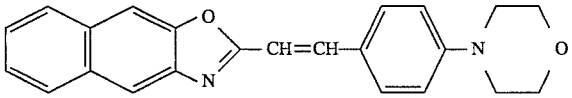
I-32
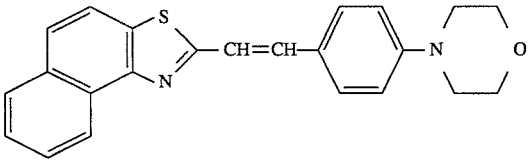
I-33
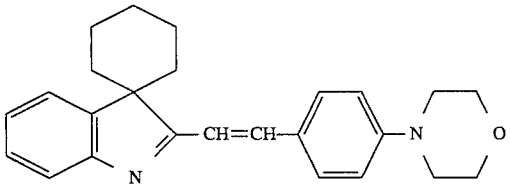
I-34
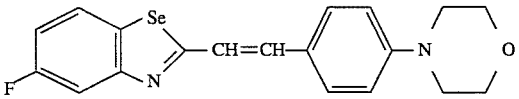
I-35
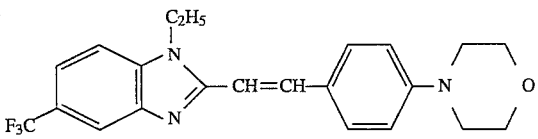
I-36
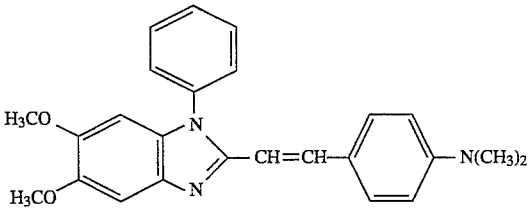
I-37
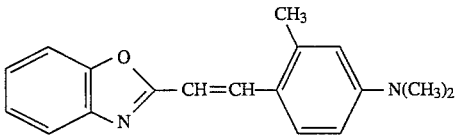

-continued
I-38
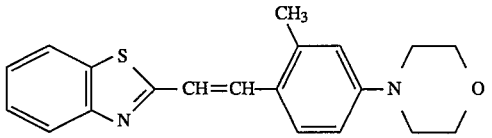
I-39
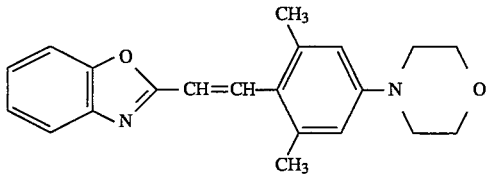
I-40
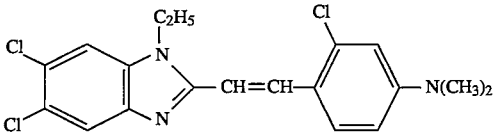
I-41
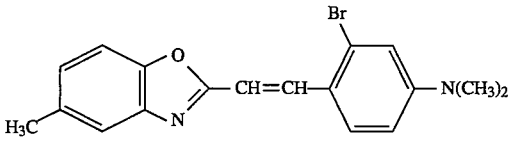
I-42
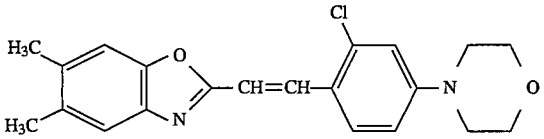
I-43
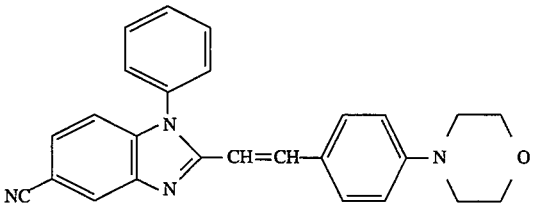
I-44
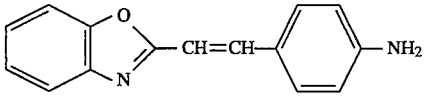
I-45
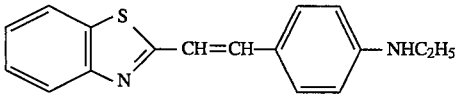
I-46
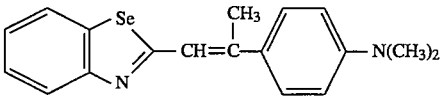
I-47
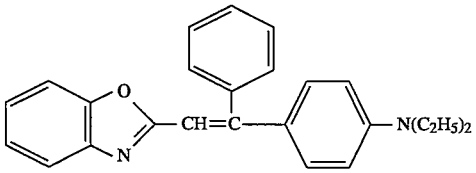
I-48
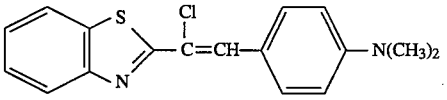
I-49
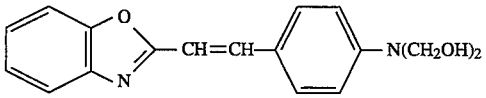
I-50
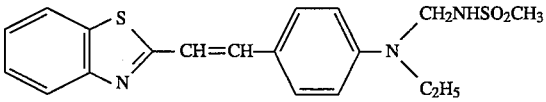
I-51
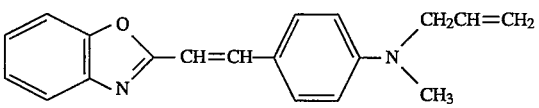
I-52
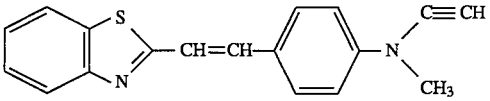
I-53
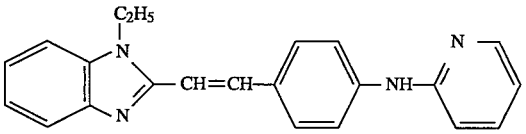
I-54
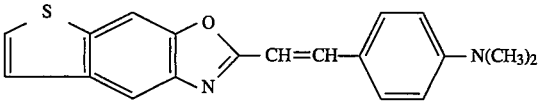
I-55
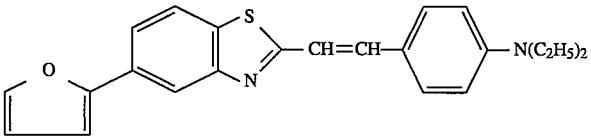
I-56
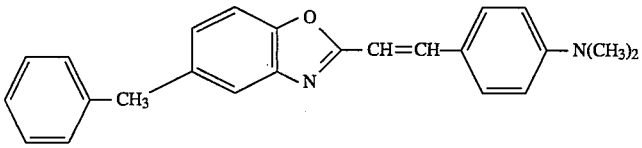

Hereunder, practical synthesis examples of the present invention will be described. Other compounds can be synthesized easily in a similar manner. Synthesis example 1 (Synthesis of exemplified compound I-4)

To 14.9 g of 2-methylbenzothiazole, 17.7 g of p-diethylaminobenzaldehyde, 6 g of sodium hydride (contained in hard oil by 60%) and 60 cc of dimethylformamide. The mixture was subjected to reaction for 30 seconds at room temperature. The reacted solution was poured to water and a precipitate was filtrated. The precipitate was dried and re-crystallized from methanol. Thus, the objective compound was obtained. The amount obtained was 19.4 g (the yield was 63%).

A compound represented by Formula [II] is explained more in detail.

In Formula [II], alkyl groups represented by $R^1$ through $R^7$ include methyl, ethyl, propyl, i-propyl, butyl, t-butyl, n-pentyl, cyclopentyl, n-hexyl, cyclohexyl, n-octyl, and n-dodecyl.

An alkenyl group represented by $R^1$ through $R^7$ is, for example, vinyl or allyl, which may be substituted.

An aryl group represented by $R^1$ through $R^7$ is, for example, phenyl or naphtyl.

A heterocyclic group represented by $R^1$ through $R^7$ is, for example, pyridyl such as 2-pyridyl, 3-pyridyl and 4-pyridyl, thiazolyl, oxazolyl, imidazolyl, furyl, thienyl, pyrolyl, pyradinyl, pylimidyl, pyridadinyl, selenazolyl, sulforanyl, pyperidynyl, pyrazolyl or tetrazolyl.

These alkyl, alkenyl alkynyl, aryl and heterocyclic groups may be substituted by a halogen atom such as chlorine, bromine or fluorine, an alkoxy group such as methoxy, ethoxy, 1,1-dimethylethoxy, n-hexyloxy or n-dodecyloxy, an aryloxy group such as phenyloxy or naphtyloxy, an aryl group such as phenyl or naphtyl, an alkoxycarbonyl group such as methoxycarbonyl, ethoxycarbonyl, n-butoxycarbonyl or 2-ethylhexylcarbonyl, an aryloxycarbonyl group such as phenoxy carbonyl or naphtyloxycarbonyl, an alkenyl group such as vinyl or allyl, a heterocyclic group such as 2-pyridyl, 3-pyridyl, 4-pyridyl, morpholyl, pyperidyl, pyperadyl, pyrimidyl, pyrazplyl or furyl, an alkynyl group such as propargyl, an amino group such as amino, N,N-dimethylamino or anilino, a hydroxyl group, a cyano group, a sulfo group, a carboxyl group, and sulfonamide group such as methylsulfonylamino, ethylsulfonylamino, butylsulfonylamino, octylsulfonylamino or phenylsulfonylamino.

$R^3$ and $R^4$ may combine with each other to form a 5- or 6-membered ring such as benzene, naphthalene, pyridine and thiophene rings, which may be substituted.

As anions represented $X^-$ in Formula [II], halide ions such as fluoride, chloride, bromide and iodide ions, sulfonates such as benzene-sulfonate and p-toluenesulfonate ions are cited.

Hereunder, compounds represented by Formula [II] are exemplfied as below, but the present invention is not limited thereto.

II-1

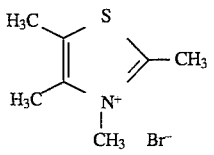

-continued

II-2

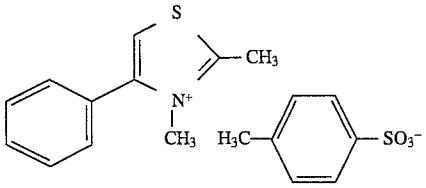

II-3

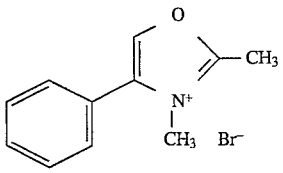

II-4

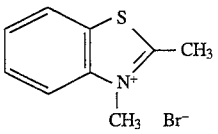

II-5

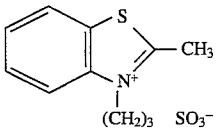

II-6

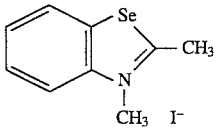

II-7

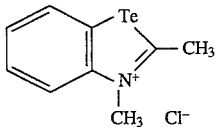

II-8

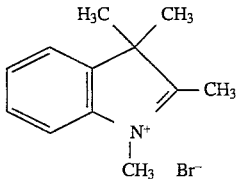

II-9

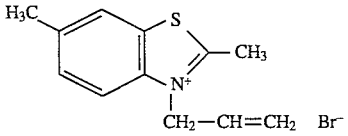

II-10

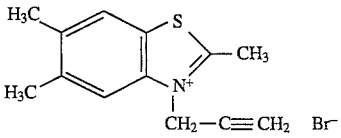

-continued
II-11
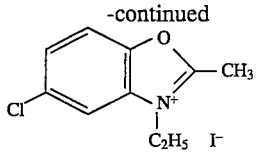
II-12
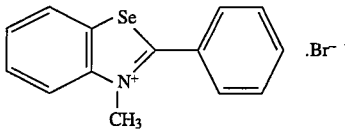
II-13
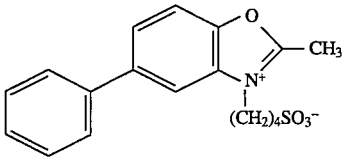
II-14
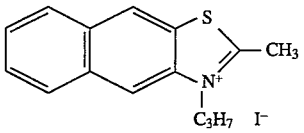
II-15
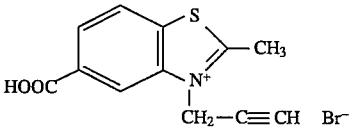
II-16
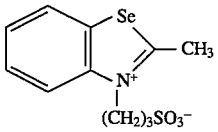
II-17
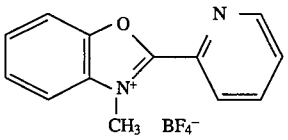
II-18
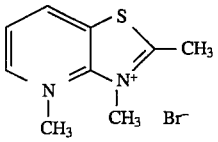
II-19
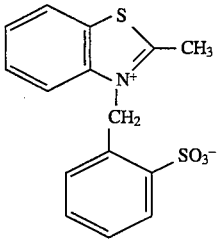
II-20
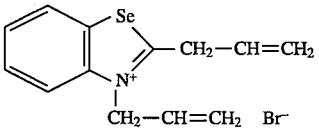
-continued
II-21
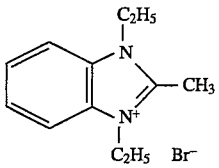
II-22
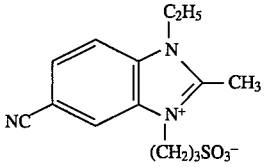
II-23
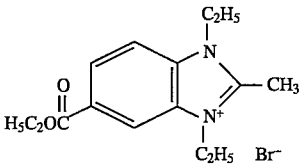
II-24
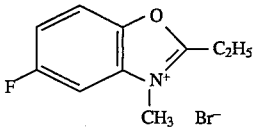
II-25
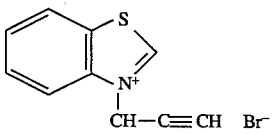
II-26
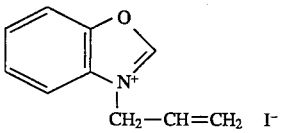
II-27
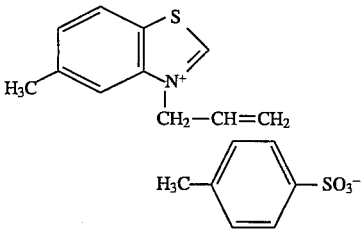
II-28
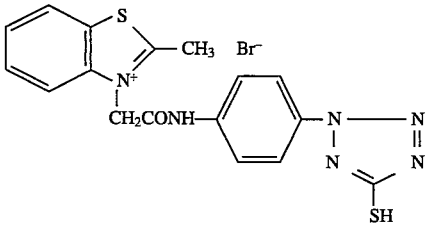

-continued

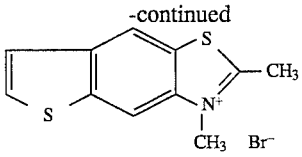

II-29

The added amount of the compound of the present invention is preferably $2\times10^{-7}$ to $1\times10^{-2}$ mol and more preferably $2\times10^{-7}$ to $5\times10^{-3}$ mol per mol of silver halide.

As a method to add the compound of the present invention to a silver halide emulsion, methods known widely in the art can be used. For example, the compound can be dispersed in an emulsion directly. The compound is dissolved in a solvent water-miscible such as pyridine, methanol, ethanol, methyl cellosolve, acetone, fluorinated alcohol, dimethylformamide or mixture thereof, or it is diluted with water or dissolved in water. Thereafter, the compound can be added in a form of a solution. During dissolution, ultrasonic vibration can be used.

In addition, there may be used a method disclosed in U.S. Pat. No. 3,469,987 wherein the compound of the present invention is dissolved in a volatile organic solvent, the resulting solution is dispersed in a hydrophilic colloid and the resulting dispersion is added to an emulsion, and a method disclosed in Japanese Patent Publication No. 24185/1971 wherein the compound is dispersed in a water-soluble solvent without dissolving a dye insoluble in water and the resulting dispersed solution is added to an emulsion.

In addition, the compound of the present invention can be added to an emulsion in a form of a dispersion prepared by an acid dissolution and dispersion method.

In the present invention, the monomethine cyanine dye, the trimethinecyanine dye and the supersensitizer may be added at any time during a period from the formation of silver halide grains to just before coating. Especially, it is preferable that they be added in the duration from the completion of the formation of silver halide grains to the completion of chemical sensitization. In addition, the monomethine cyanine dye, the trimethinecyanine dye and the supersensitizer may be added to a silver halide emulsion concurrently or separately.

In the present invention, as silver halide emulsions, those described in Research Disclosure No. 308119 (hereinafter abbreviated as RD 308119) can be used. Hereunder, places described are shown.

| [Item] | [Page in RD 308119] |
|---|---|
| Composition of iodide | 993 Section I-A |
| Manufacturing method | 993 Section I-A and 994 Section E |
| Crystal habit | |
| regular | 993 Section I-A |
| twinned | 993 Section I-A |
| Epitaxial | 993 Section I-A |
| Halide composition | |
| uniform | 993 Section I-B |
| nonuniform | 993 Section I-B |
| Halide conversion | 994 Section I-C |
| Halide substitution | 994 Section I-C |
| Metal inclusion | 994 Section I-D |
| Monodispersion | 995 Section I-F |

-continued

| [Item] | [Page in RD 308119] |
|---|---|
| Solvent addition | 995 Section I-F |
| Position of latent image formation | |
| surface | 995 Section I-G |
| internal | 995 Section I-G |
| Application | |
| negative | 995 Section I-H |
| positive (including internal fogging grains) | 995 Section I-H |
| Emulsions blended | 995 Section I-J |
| Desalting | 995 Section II-A |

In the present invention, the silver halide emulsion which is subjected to physical ripening, chemical ripening and spectral sensitization is employed. Additives used in the above-mentioned steps are described in Research disclosure Nos. 17643, 18716 and 308119 (hereinafter, they are respectively abbreviated as RD 17643, 18716 and 308119). Hereunder, places described will be shown.

| [Item] | [Page in RD 308119] | [RD 17643] | [RD 18716] |
|---|---|---|---|
| Chemical sensitizer | 996 Section III-A | 23 | 648 |
| Spectral sensitizer | 996 Section IV-A-A, B, C, D, E, H, I and J | 23–24 | 648–9 |
| Supersensitizer | 996 Section IV-A–E and J | 23–24 | 648–9 |
| Anti-foggant | 998 Section VI | 24–25 | 649 |
| Stabilizer | 998 Section VI | 24–25 | 649 |

In addition, photographic additives capable of being used in the present invention are disclosed in the above-mentioned Research Disclosures. Hereunder, places described will be shown.

| [Item] | [Page in RD 308119] | [RD 17643] | [RD 18716] |
|---|---|---|---|
| Anti-color stain agent | 1002 Section VII-I | 25 | 650 |
| Dye image stabilizer | 1001 Section VII-J | 25 | |
| Whitening agent | 998 V | 24 | |
| UV absorber | 1003 Section VIII C and XIII C | 25–26 | |
| Light absorber | 1003 Section VIII | 25–26 | |
| Light scattering agent | 1003 Section VIII | | |
| Filter dye | 1003 Section VIII | 25–26 | |
| Binder | 1003 Section IX | 26 | 651 |
| Anti-static agent | 1006 Section XIII | 27 | 650 |
| Hardener | 1004 Section X | 26 | 651 |
| Plasticizer | 1006 Section XII | 27 | 650 |
| Lubricant | 1006 Section XII | 27 | 650 |
| Activator and coating aid | 1005 Section XI | 26–27 | 650 |
| Matting agent | 1007 Section X VI | | |
| Developing agent (contained in a light-sensitive material) | 1011 Section XX-B | | |

In the present invention, various couplers can be used. The practical examples are described in the above-mentioned Research Disclosure. Hereunder, places related thereto are shown.

| [Item] | [Page in RD 308119] | [RD 17643] | [RD 18716] |
|---|---|---|---|
| Yellow coupler | 1001 Section VII-D | VII | Items C through G |
| Magenta coupler | 1001 Section VII-D | VII | Items C through G |
| Cyan coupler | 1001 Section VII-D | VII | Items C through G |
| Colored coupler | 1002 Section VII-G | VII | Item G |
| DIR coupler | 1001 Section VII-F | VII | Item F |
| BAR coupler | 1002 Section VII-F | | |
| Other useful group releasing couplers | 1001 Section VII-F | | |
| Alkaline-soluble coupler | 1001 Section VII-E | | |

additives used in the present invention can be added by means of an addition method described in RD 308119 XIV.

In the present invention, supports described in the above-mentioned RD 17643, on page 28, RD 18716 on pp. 647 to 648 and RD 308119, in X can be used.

To the light-sensitive material of the present invention, auxiliary layers such as filter layers and intermediate layer described in the above-mentioned RD 308119, in Item VII-K can be provided.

The light-sensitive material of the present invention can take a form of various layer structures such as an ordinary layer structure, a reverse layer structure and a unit structure described in the above-mentioned RD 308119, in Item VII-K.

The present invention can be used in various color photographic light-sensitive materials typically including a color negative film for movie use, a color reversal film for slide use or television use and a color positive film.

In the present invention, the total layer thickness of all hydrophilic colloidal layers on a side having emulsion layers is preferably 24 μm or less, more preferably 20 μm or less and especially more preferably 18 μm or less. In addition, swelling speed $T_{1/2}$ is preferably 30 seconds or less and more preferably 20 seconds or less. Layer thickness is defined to be the layer thickness measured under the conditions of 25° C. and relative humidity of 55% (2 hr). The swelling speed $T_{1/2}$ can be measured by means of a conventional method.

The swelling speed $T_{1/2}$ can be adjusted by adding a hardener to gelatin which is used as a binder or by changing the aging condition after being coated. In addition, the swelling ratio is preferably 150 to 400%. The swelling ratio can be calculated from the maximum swelling layer thickness under the above-mentioned conditions as follows: (Maximum swelling layer thickness—layer thickness)/layer thickness=Swelling ratio Color light-sensitive materials can be subjected to photographic processing by the use of a conventional method described in the above-mentioned RD 17643, on pp. 28 and 29 and RD 18716, on page 615, from the left column to the right column.

When the light-sensitive material is used in a roll form, it is preferable to take a form of including in a cartridge. As a cartridge, the most common one is the existing 135 format cartridge. In addition, cartridges disclosed in the following patents can be used.

Japanese utility Model Application Open to Public Inspection No. 67329/1983, Japanese Patent O.P.I. Publication No. 181035/1983, U.S. Pat. No. 4,221,479, Japanese Patent O.P.I. Publication Nos. 231045/1989 and 199451/1990 and U.S. Pat. Nos. 4,846,418, 4,848,693 and 4,832,275.

In addition, the present invention is applicable to "Compact roll film cartridge and film camera for photographic use" applied on Jan. 31, 1992 (by Toshihiko Yagi and others).

The light-sensitive material can be subjected to photographic processing by means of conventional methods described in the above-mentioned RD 17643, on pp. 28 to 29 and RD 308119, in Item XIX.

EXAMPLES

Hereunder, practical examples of the present invention will be described. However, the embodiment of the present invention is not limited thereto.

In the following examples, the amount of each additives represents gram number per 1 $m^2$ otherwise not specified especially. In addition, silver halide and colloidal silver are represented in conversion to silver. Sensitizing dyes are represented by the number of moles per mol of silver.

Example 1

(Preparation of seed emulsion T-I)

By the following method, an emulsion having 2 parallel twinned surfaces was prepared.

| | |
|---|---|
| Solution A | |
| Ossein gelatin | 80.0 g |
| Potassium bromide | 47.4 g |
| Polyisopropyrene - polyethyleneoxy - succinate disodium salt (10% methanol solution) | 0.48 cc |
| Water was added to make 8000.0 cc in total. | |
| Solution B | |
| Silver nitrate | 1200.0 g |
| Water was added to make 1600.0 cc in total. | |
| Solution C | |
| Ossein gelatin | 32.2 g |
| Potassium bromide | 790.0 g |
| Potassium iodide | 70.34 g |
| Water was added to make 1600.0 cc in total. | |
| Solution D | |
| Aqueous ammonia | 470.0 cc |

To Solution A stirred vigorously at 40° C., Solution B and Solution C were added over a period of 7.7 minutes by a double jet method so that nuclei were produced, while pBr was kept at 1.60.

Thereafter, the temperature was lowered to 30° C. over 30 minutes. Then, Solution D was added for 1 minute. Succeedingly, the mixture was subjected to ripening for 5 minutes, in which the concentration of potassium bromide was 0.03 mol/liter and the density of ammonia was 0.66 mol/liter.

After ripening, pH was adjusted to 6.0 and subjected to desalting by a conventional method. This seed emulsion grains were observed using an electron microscope, they were hexagonal-tabular grains having 2 twinned planes parallel with each other.

The average grain size of this seed emulsion grains was 0.217 μm, and the proportion of 2 parallel twinned planes was 75% to the total grains in terms of number. (Preparation of emulsion EM-1 of the present invention)

Using 7 kinds of solutions shown below, octahedral twinned crystal mono-dispersed emulsion EM-1 of the present invention having 2 parallel twinned planes was prepared.

| Solution A | |
|---|---|
| Ossein gelatin | 61.0 g |
| Distilled water | 1963.0 cc |
| Polyisopropyrene-polyethyleneoxy - succinate disodium salt (10% methanol solution) | 2.5 cc |
| Seed emulsion (T-1) | 0.345 mol |
| 28 wt % aqueous ammonia solution | 308.0 cc |
| 56 wt % aqueous acetic acid solution | 358.0 cc |
| Methanol solution containing iodine of 0.001 mol | 33.7 cc |
| Distilled water was added to make 3500.0 cc. | |
| Solution B | |
| 3.5 N aqueous ammoniacal silver nitrate solution (provided that pH was adjusted to 9.0 with ammonium nitrate) | |
| Solution C | |
| 3.5 N aqueous potassium bromide solution | |
| Solution D | |
| Fine grain emulsion* comprising 3 wt % of gelatin and silver iodide grains (the average grain size is 0.05 μm) of 1.40 mol | |

*Hereinafter, the preparation method is shown.

To 5000 cc of 6.0 wt % gelatin solution containing 0.06 mol of potassium iodide, 2000 cc of aqueous solution containing 7.06 mol of silver nitrate and 2000 cc of aqueous solution containing 7.06 mol of potassium iodide were added for 10 minutes, while pH was adjusted to 2.0 using nitric acid and the temperature was controlled at 40° C. After forming the grains, pH was adjusted to 6.0 using an aqueous sodium carbonate solution.

Solution E

Fine grain emulsion comprising of silver bromoiodide grains of 3.68 mol (the average grain size of 0.04 μm) containing 2 mol % of silver iodide, prepared in a manner similar to the silver iodide fine grains emulsion described in Solution D, provided that the temperature during formation of fine grains was controlled at 30° C.

Solution F

An aqueous 1.75 N potassium bromide solution

Solution G

An aqueous 56 wt % acetic acid solution

To Solution A whose temperature was kept at 70° C. in a reactor vessel, Solutions B, C and D were added over a period of 128 minutes by means of a simultaneous mixing method. Thereafter, Solution E was added at a constant rate for 7 minutes. Thus, seed crystals were grown up to 0.806 μm.

Here, addition rates of Solutions B and C were changed acceleratingly so as to be commensulated with the critical growth rate. Addition speeds were controlled appropriately so as to prevent making poly-dispersion due to the formation of fine grains other than seed grains Ostwald's ripening. Supplying of Solution D, i.e. the silver iodide fine grain emulsion, was controlled in such a manner that the flow rate ratio (mol % ratio) of Solution D to an aqueous ammoniacal silver nitrate solution was changed in accordance with the grain size (or addition time), as shown in Table 1. Thus, a core/shell type silver halide emulsion having a multiple structure was prepared.

In addition, using Solutions F and G, pAg and pH in the course of crystal growth were controlled as shown in Table 1. pAg and pH were measured by a conventional method using a silver sulfate electrode and a glass electrode.

After grain formation was completed, they were subjected to desalting by a method described in Japanese Patent Application No. 41314/1991. Then, gelatin was added for redispersion. pH and pAg were respectively adjusted to 5.80 and 8.06 at 40° C. From a microphotograph of a scanning electron microscope of the resulting emulsion grains, it was observed that the resulting emulsion was a mono-dispersed octahedral twinned crystal grain emulsion having an average grain size of 0.806 μm and a width of distribution of 12.0%.

TABLE 1

| | Addition time (minute) | Grain size (μm) | Flow rate ratio of Solution D (mol %) | pH | pAg |
|---|---|---|---|---|---|
| Layer (I) | 0.0 | 0.217 | 6.0 | 7.2 | 7.8 |
| | 26.20 | 0.345 | 20.1 | 7.2 | 7.8 |
| | 40.86 | 0.394 | 29.5 | 7.2 | 7.8 |
| Layer (II) | 41.57 | 0.397 | 30.0 | 7.2 | 7.8 |
| | 54.11 | 0.434 | 30.0 | 7.2 | 7.8 |
| | 64.89 | 0.466 | 30.0 | 7.2 | 7.8 |
| Layer (III) | 67.98 | 0.476 | 28.9 | 7.2 | 7.8 |
| | 96.53 | 0.593 | 7.7 | 7.2 | 7.8 |
| | 96.53 | 0.593 | 0.0 | 6.5 | 9.4 |
| | 126.33 | 0.730 | 0.0 | 6.5 | 9.7 |
| | 128.00 | 0.745 | 0.0 | 6.5 | 9.7 |

Emulsion EM-1 was subjected to chemical sensitization using sodium thiosulfate, chloro aurate and ammonium thiocyanate. Then, the emulsion was divided into 10 portions. To each of them, the following sensitizing dye and supersensitizer were added simultaneously as shown in Table 2 so that Emulsions (A) through (J) were prepared.

Emulsions (A) through (J) were further ripened at 50° C. for 20 minutes. Thereafter, 4-hydroxy-6-methyl-1,3,3a,7-tetrazaindene and 1-phenyl-5-mercapto tetrazole were added thereto for stabilizing.

In addition, to the mixture, a dispersion prepared by dissolving the following magenta coupler [I] in ethyl acetate and tricresylacetate and dispersing in an aqueous gelatin solution, and conventional photographic additives such as a spreading agent and a hardener were added so that a coating solution was prepared. The coating solution was coated on a subbed triacetate cellulose support and dried by a conventional method. Thus, samples 101 through 110 were prepared.

Magenta coupler [I]

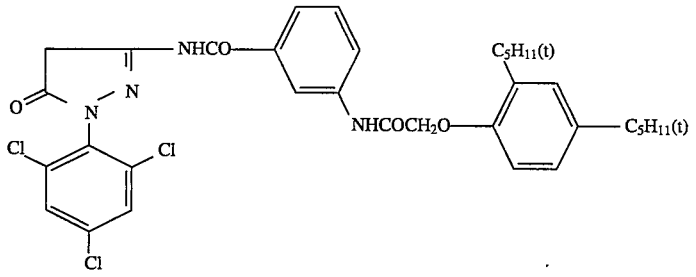

TABLE 2

| Emulsion | Sensitizing dye (mol/mol AgX) | | Supersensitizer (mol/mol AgX) | | Addition method of sensitizing dye in a silver halide emulsion |
|---|---|---|---|---|---|
| A (Comparative) | S-27 | $2 \times 10^{-4}$ | | | a |
| | S-48 | $2 \times 10^{-4}$ | | | |
| B (Comparative) | S-27 | $2 \times 10^{-4}$ | | | b |
| | S-48 | $2 \times 10^{-4}$ | | | |
| C (Comparative) | S-27 | $1.5 \times 10^{-4}$ | | | a |
| | S-48 | $1.5 \times 10^{-4}$ | | | |
| | S-10 | $1.5 \times 10^{-4}$ | | | |
| D (Comparative) | S-27 | $1.5 \times 10^{-4}$ | | | b |
| | S-48 | $1.5 \times 10^{-4}$ | | | |
| | S-10 | $1.5 \times 10^{-4}$ | | | |
| E (Comparative) | S-27 | $2 \times 10^{-4}$ | I-4 | $2 \times 10^{-5}$ | b |
| | S-48 | $2 \times 10^{-4}$ | | | |
| F (Invention) | S-27 | $1.5 \times 10^{-4}$ | Compound (1) | $2 \times 10^{-5}$ | a |
| | S-48 | $1.5 \times 10^{-4}$ | | | |
| | S-10 | $1.5 \times 10^{-4}$ | | | |
| G (Invention) | S-27 | $1.5 \times 10^{-4}$ | I-4 | $2 \times 10^{-5}$ | a |
| | S-48 | $1.5 \times 10^{-4}$ | | | |
| | S-10 | $1.5 \times 10^{-4}$ | | | |
| H (Invention) | S-27 | $1.5 \times 10^{-4}$ | I-10 | $2 \times 10^{-5}$ | a |
| | S-48 | $1.5 \times 10^{-4}$ | | | |
| | S-10 | $1.5 \times 10^{-4}$ | | | |
| I (Invention) | S-27 | $1.5 \times 10^{-4}$ | I-15 | $2 \times 10^{-5}$ | a |
| | S-48 | $1.5 \times 10^{-4}$ | | | |
| | S-10 | $1.5 \times 10^{-4}$ | | | |
| J (Invention) | S-27 | $1.5 \times 10^{-4}$ | I-4 | $2 \times 10^{-5}$ | b |
| | S-48 | $1.5 \times 10^{-4}$ | | | |
| | S-10 | $1.5 \times 10^{-4}$ | | | |

In Table 2, addition methods of a sensitizing dye a and b were as follows; a: A solution prepared by dissolving a sensitizing dye in methyl alcohol in a concentration of 0.5% was added. b: A solution prepared by dispersing a sensitizing dye in water in the form of solid particles was added.

Compound (1)

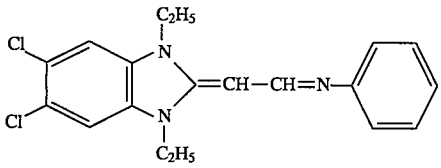

Samples 101 through 110 were respectively divided into 2 groups I and II. Group I was subjected to wedge exposure to light according to a conventional method. Immediately thereafter, they were subjected to photographic processing in accordance with the following processing steps. On the other hand, after Group II was subjected to wedge exposure to light in the same manner as in Group I, they were left to stand for 7 days at 23° C. and 55% RH before being subjected to photographic processing. In both cases of Group I and Group II, wedge exposure was minus blue exposure by means of filter operation.

The sensitivity of each sample was represented by the a reciprocal of the exposure amount giving an optical density of the fogging density+0.15, and represented by a relative value when density of Sample 101 was defined to be 100.

The results thereof was shown in Table 3. Processing procedure

| Processing step | Processing time | Processing temperature | Replenishing amount |
|---|---|---|---|
| Color developing | 3 min. 15 sec. | 38 ± 0.3° C. | 780 cc |
| Bleaching | 45 sec. | 38 ± 2.0° C. | 150 cc |
| Fixing | 1 min. 30 sec. | 38 ± 2.0° C. | 830 cc |
| Stabilizing | 1 min. | 38 ± 5.0° C. | 830 cc |
| Drying | 1 min. | 55 ± 5.0° C. | — |

-continued

| Processing step | Processing time | Processing temperature | Replenishing amount |
|---|---|---|---|

*Replenishing amounts are values per 1 $m^2$ of light-sensitive material.

The following color developer, the bleacher, the fixer, the stabilizer and their replenisher were used.

| Color developer and a replenisher thereof | Developer | Replenisher |
|---|---|---|
| Water | 800 cc | 800 cc |
| Potassium carbonate | 30 g | 35 g |
| Sodium hydrocarbon | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| Sodium chloride | 4.5 g | 6.3 g |
| 4-amino-3-methyl-N-ethyl-N-(β-hydroxyethyl)aniline sulfate | | |
| Diethylenetriamine pentaacetic acid | 3.0 g | 3.0 g |
| Potassium hydroxide | 1.2 g | 2.0 g |

Water was added to make 1 liter. Using potassium hydroxide or 20% sulfuric acid, pH of the color developer was regulated to 10.06, and pH of the replenisher was regulated to 10.18.

| Bleach and a replenisher thereof | Bleach | Replenisher |
|---|---|---|
| Water | 700 cc | 700 cc |
| 1,3-diaminopropane pentaacetic ferric (III) ammonium | 125 g | 175 g |
| Ethylenediamine pentaacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter. By the use of aqueous ammonia or glacial acetic acid, the pH of bleach and replenisher thereof were adjusted to 4.4 and 4.0, respectively.

| Fixer and a replenisher thereof | Fixer | Replenisher |
|---|---|---|
| Water | 800 cc | 800 cc |
| Ammonium thiocyanate | 120 g | 150 g |
| Ammonium thiosulfate | 150 g | 180 g |
| Sodium nitrite | 15 g | 20 g |
| Ethylenediamine tetraacetic acid | 2 g | 2 g |

The pH of the fixer was regulated to 6.2 using aqueous ammonia or glacial acetic acid. After pH of the replenisher was adjusted to 6.5, water was added to make 1 liter. Stabilizer and the replenisher for stabilizer

| | |
|---|---|
| Water | 900 cc |
| p-octylphenol-ethyleneoxide adduct | 2.0 g |
| Dimethylol urea | 0.5 g |
| Hexamethylene tetraamine | 0.2 g |
| 1,2-benzoisothiazoline-3-on | 0.1 g |

-continued

| | |
|---|---|
| Siloxane (L-77 produced by UCC) | 0.1 g |
| Aqueous ammonia | 0.5 cc |

After water was added to make 1 liter, pH was adjusted to 8.5 using an aqueous ammonia or 50% sulfuric acid.

TABLE 3

| Sample No. | Silver halide emulsion | Sensitivity (Group I) | Sensitivity (Group II) | Fog (Group I) |
|---|---|---|---|---|
| 101 (Comparative) | A | 100 | 90 | 0.13 |
| 102 (Comparative) | B | 102 | 90 | 0.11 |
| 103 (Comparative) | C | 80 | 55 | 0.10 |
| 104 (Comparative) | D | 85 | 60 | 0.10 |
| 105 (Comparative) | E | 120 | 110 | 0.18 |
| 106 (Comparative) | F | 120 | 105 | 0.15 |
| 107 (Inventive) | G | 120 | 115 | 0.13 |
| 108 (Inventive) | H | 120 | 120 | 0.13 |
| 109 (Inventive) | I | 120 | 115 | 0.11 |
| 110 (Inventive) | J | 125 | 125 | 0.11 |

From Table 3, it is understood that the samples of the present invention are improved in fog while high sensitivity is kept. In addition, it also can be understood that latent image storage stability of inventive samples was noticeably improved.

Example 2

A multilayered color light-sensitive material comprising a subbed triacetate cellulose film support provided thereon layers each having the following composition was prepared. The sample was defined to be Sample 201. The amount of additive was represented by gram number per 1 $m^2$ of light-sensitive material. The silver halide emulsion and colloidal silver were represented by values converted to silver. In addition, the amount of a sensitizing dye was represented by mol number per mol of silver halide contained in the same layer.

| | |
|---|---|
| 1st layer: Anti-halation layer (HC) | |
| Black colloidal silver | 0.16 |
| UV absorber (UV-1) | 0.30 |
| Gelatin | 1.70 |
| 2nd layer: Intermediate layer (IL-1) | |
| Gelatin | 0.80 |
| 3rd layer: Low-speed red sensitive layer (RL) | |
| Silver bromoiodide emulsion (the average grain size is 0.20 μm) | 0.40 |
| Sensitizing dye (S-1) | $1.2 \times 10^{-4}$ |
| Sensitizing dye (S-2) | $0.2 \times 10^{-4}$ |
| Sensitizing dye (S-3) | $2.0 \times 10^{-4}$ |
| Sensitizing dye (S-4) | $1.2 \times 10^{-4}$ |
| Cyan coupler (C-1) | 0.33 |
| Colored cyan coupler (CC-1) | 0.05 |
| High boiling solvent (Oil-1) | 0.30 |
| Gelatin | 0.55 |
| 4th layer: Medium-speed red sensitive layer (RM) | |
| Silver bromoiodide emulsion (the average grain size is 0.40 μm) | 0.48 |
| Sensitizing dye (S-1) | $1.5 \times 10^{-4}$ |
| Sensitizing dye (S-2) | $0.2 \times 10^{-4}$ |
| Sensitizing dye (S-3) | $2.5 \times 10^{-4}$ |
| Sensitizing dye (S-4) | $1.5 \times 10^{-4}$ |
| Cyan coupler (C-1) | 0.30 |

-continued

| | |
|---|---|
| Colored cyan coupler (CC-1) | 0.05 |
| High boiling solvent (Oil-1) | 0.40 |
| Gelatin | 0.60 |
| 5th layer: High-speed red sensitive layer (RH) | |
| Silver bromoiodide emulsion (the average grain size is 0.51 μm) | 0.66 |
| Sensitizing dye (S-1) | $1.0 \times 10^{-4}$ |
| Sensitizing dye (S-2) | $0.2 \times 10^{-4}$ |
| Sensitizing dye (S-3) | $1.7 \times 10^{-4}$ |
| Sensitizing dye (S-4) | $1.0 \times 10^{-4}$ |
| Cyan coupler (C-2) | 0.10 |
| Colored cyan coupler (CC-1) | 0.01 |
| DIR compound (D-1) | 0.02 |
| High boiling solvent (Oil-1) | 0.15 |
| Gelatin | 0.53 |
| 6th layer: Intermediate layer (IL-2) | |
| Gelatin | 0.80 |
| 7th layer: Low-speed green sensitive layer (GL) | |
| Silver bromoiodide emulsion (the average grain size is 0.40 μm) | 0.60 |
| Silver bromoiodide emulsion (the average grain size is 0.30 μm) | 0.40 |
| Sensitizing dye (S-1) | $0.6 \times 10^{-4}$ |
| Sensitizing dye (S-5) | $5.1 \times 10^{-4}$ |
| Magenta coupler (M-1) | 0.55 |
| Colored magenta coupler (CM-1) | 0.17 |
| DIR compound (D-2) | 0.03 |
| High boiling solvent (Oil-2) | 0.70 |
| Gelatin | 1.56 |
| 8th layer: High-speed green sensitive layer (GH) | |
| Silver halide emulsion A | 0.60 |
| Magenta coupler (M-1) | 0.06 |
| Magenta coupler (M-2) | 0.02 |
| Colored magenta coupler (CM-2) | 0.02 |
| DIR compound (D-3) | 0.002 |
| High boiling solvent (Oil-2) | 0.15 |
| Gelatin | 0.45 |
| 9th layer: Yellow filter layer (YC) | |
| Yellow colloidal silver | 0.08 |
| Formalin scavenger (HS-1) | 0.20 |
| Anti-stain agent (HS-2) | 0.15 |
| High boiling solvent (Oil-2) | 0.19 |
| Gelatin | 0.80 |
| 10th layer: Low-speed green sensitive layer (BL) | |
| Silver bromoiodide emulsion (the average grain size is 0.40 μm) | 0.18 |
| Silver bromoiodide emulsion (the average grain size is 0.30 μm) | 0.35 |
| Sensitizing dye (S-9) | $5.1 \times 10^{-4}$ |
| Sensitizing dye (S-10) | $2.0 \times 10^{-4}$ |

-continued

| | |
|---|---|
| Yellow coupler (Y-1) | 0.58 |
| Yellow coupler (Y-2) | 0.30 |
| High boiling solvent (Oil-2) | 0.15 |
| Gelatin | 1.20 |
| 11th layer: High-speed blue sensitive layer (BH) | |
| Silver bromoiodide emulsion (the average grain size is 0.88 μm) | 0.45 |
| Sensitizing dye (S-9) | $2.8 \times 10^{-4}$ |
| Sensitizing dye (S-10) | $1.0 \times 10^{-4}$ |
| Yellow coupler (Y-1) | 0.10 |
| High boiling solvent (Oil-2) | 0.04 |
| Gelatin | 0.50 |
| 12th layer: 1st protective layer (Pro-1) | |
| Silver bromoiodide emulsion (the average grain size is 0.70 μm) | 0.30 |
| UV absorber (UV-1) | 0.07 |
| UV absorber (UV-2) | 0.10 |
| High boiling solvent (Oil-2) | 0.07 |
| High boiling solvent (Oil-3) | 0.07 |
| Formalin scavenger (HS-1) | 0.25 |
| Gelatin | 0.80 |
| 13th layer: 2nd protective layer (Pro-2) | |
| Alkaline-soluble matting agent (the average grain size is 2 μm) | 0.13 |
| Polymethyl methacrylate (the average grain size is 3 μm) | 0.02 |
| Gelatin | 0.80 |

In addition to the above, Coating aid Su-1, Dispersing aid Su-2, Hardeners H-1 and H-2, Dyes AI-1 and AI-2, Stabilizer ST-1, Fog inhibitors AF-1, two kinds of AF-2 having molecular weights of 10,000 and 20,000, and Antiseptic DI-1 were added if necessary.

The structures of the compounds used for the preparation of the above-mentioned samples are shown below:

Oil-1: Dioctylphthalate

Oil-2: Tricresylphosphate

Oil-3: Dibutylphthalate

Su-1: Sodium dioctyl sulfo succinic acid

Su-2: Sodium tri-i-propylnaphthalene sulfonic acid

HS-1: 1-(3-sulfophenyl)-3-methyl-5-imino-2-pyrazoline

HS-2: 2-sec-octadecyl-5-methyl hydroquinone

H-1: Sodium 2,4-dichloro-6-hydroxy-s-triazine

H-2: Bis(vinylsulfonylmethyl)ether

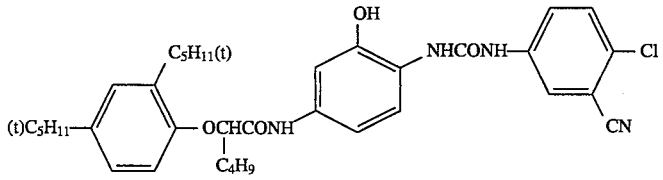

C-1

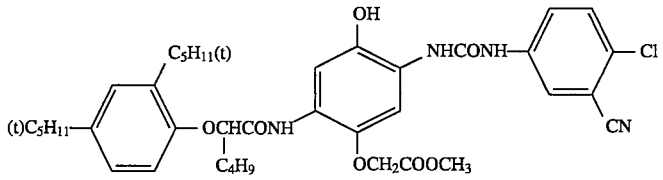

C-2

-continued
M-1
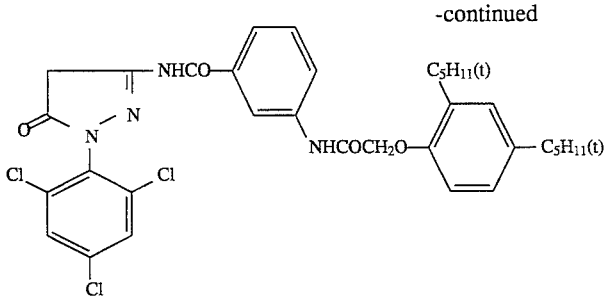
M-2
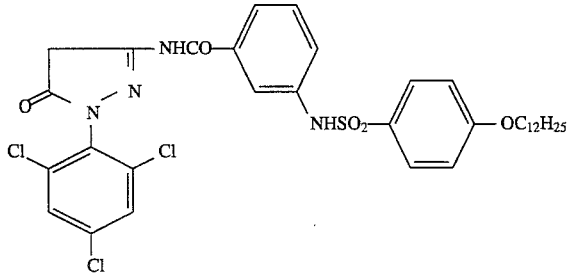
Y-1
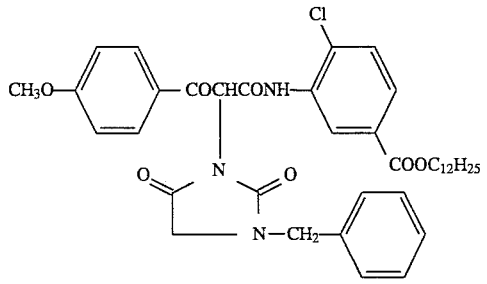
Y-2
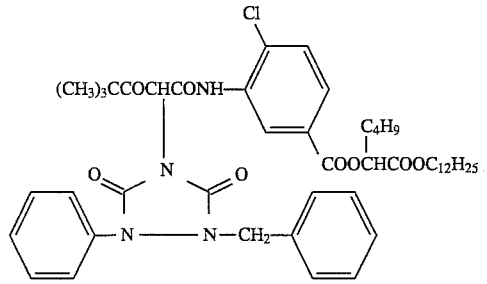
CC-1
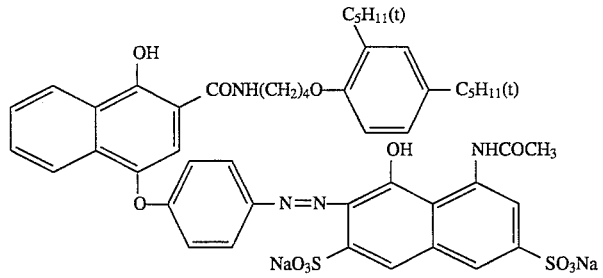

-continued
CM-1
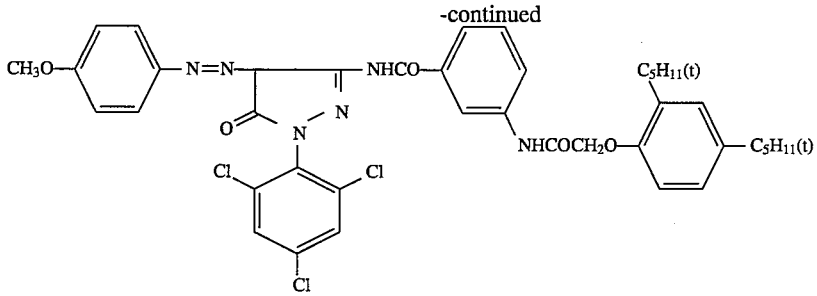
CM-2
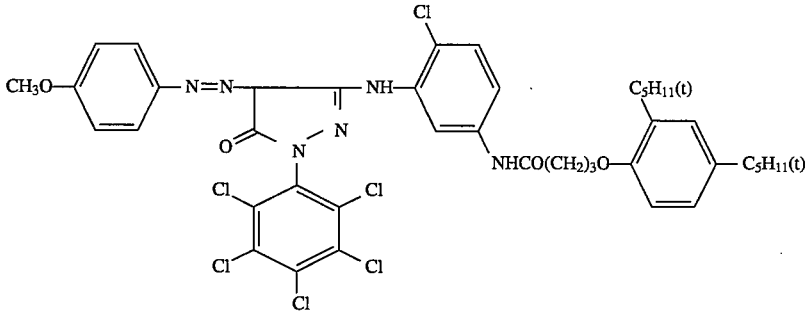
D-1
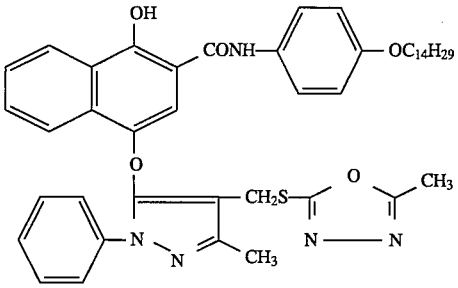
D-2
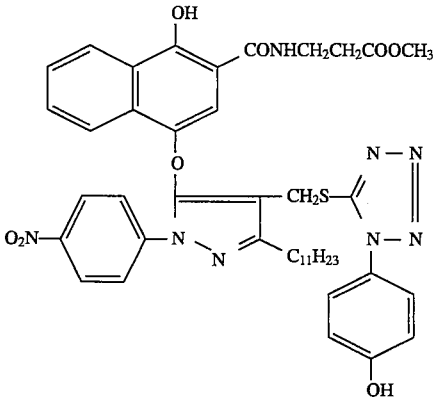
D-3
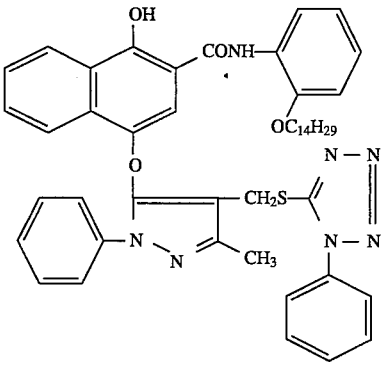

-continued
UV-1
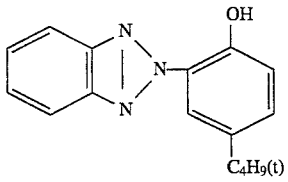
UV-2
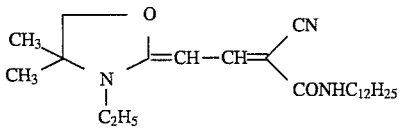
S-1
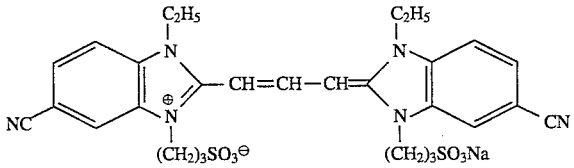
S-2
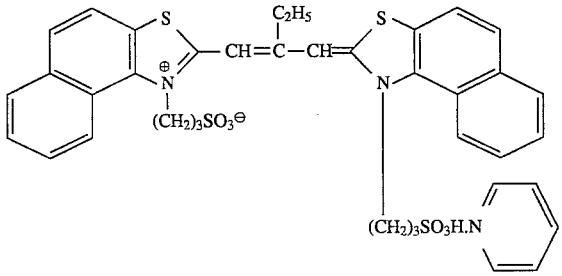
S-3
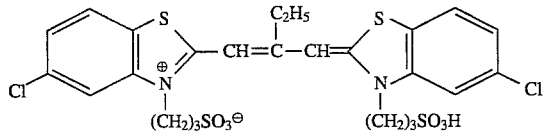
S-4
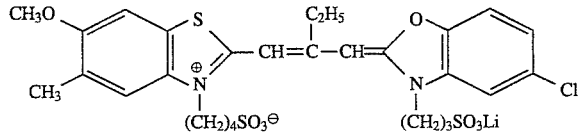
S-5
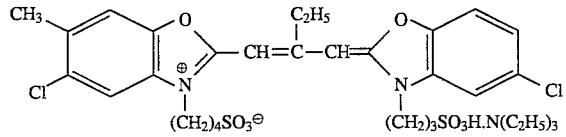
S-6
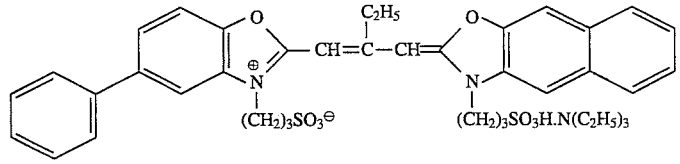
S-7
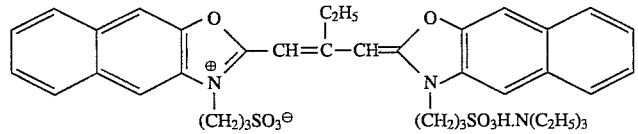

-continued
S-8
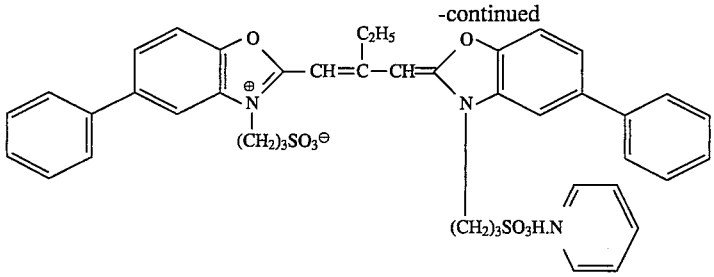
S-6
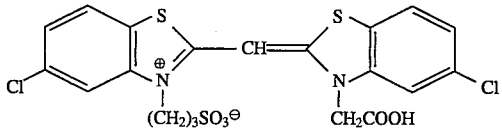
S-7
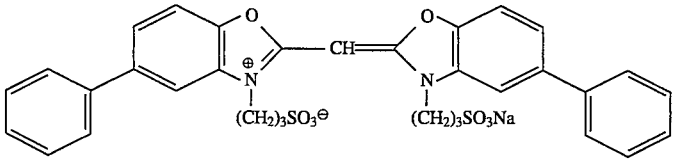
AI-1
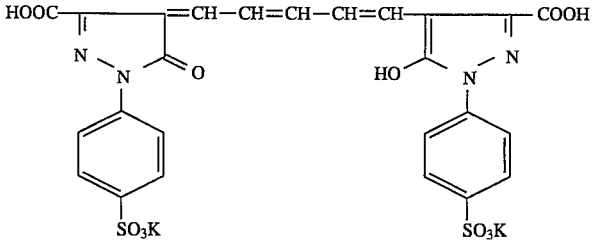
AI-2
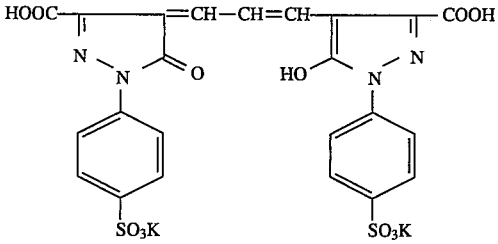
ST-1
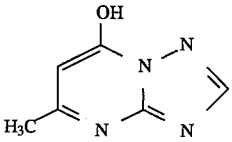
AF-1
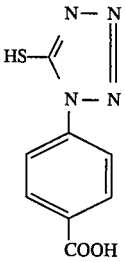
AF-2
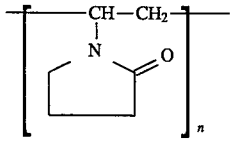

-continued

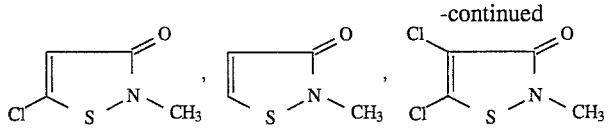

A:B:C = 50:46:4 (molar ratio)

Separately, sample Nos. 202 through 210 were prepared in the same manner as sample 201, except that silver halide emulsion A of 8th layer was replaced respectively by silver halide emulsions B through J prepared in Example 1.

Each sample was divided into 3 groups (Group I, Group II and Group III). Group I was subjected to wedge exposure to light by a conventional method. Immediately thereafter, it was subjected to photographic processing in the same manner as in Example 1. On the other hand, group II was left to stand for 7 days at 23° C. and 55% RH after being subjected to wedge exposure to light in the same manner as in Group I. Then, it was subjected to photographic processing in the same manner as Group I.

Sensitivity of each sample was represented by a reciprocal of the exposure amount necessary to give yellow density of the fogging density+0.15.

As a result, in the same manner as in Example 1, samples using the silver halide emulsion of the present invention showed improvement in latent image stability compared with Comparative examples. Concurrently, it could be understood that the sensitivity of the samples of the present invention was high and fogging density could be reduced.

Separately, samples 205 and 207 of Group III were subjected to practical photographing test of blue-green cloth under a white light source or a fluorescent light source. Then, they were subjected to photographic processing.

The negative film developed were printed on color photographic papers. With the following processing, prints were obtained.

| Processing step | Temperature (°C.) | Time |
|---|---|---|
| Color developing | 35.0 ± 0.3 | 45 sec. |
| Bleach fixing | 35.0 ± 0.5 | 45 sec. |
| Stabilizing | 30–34 | 90 sec. |
| Drying | 60–80 | 60 sec. |

| Color developer | |
|---|---|
| Pure water | 800 ml |
| Triethanol amine | 10.0 g |
| N,N-diethylhydroxylamine | 5.0 g |
| Potassium bromide | 0.02 g |
| Potassium chloride | 2.0 g |
| Potassium sulfite | 0.3 g |
| 1-hydroxyethylidene-1,1-diphosphate | 1.0 g |
| Ethylenediamine tetraacetic acid | 1.0 g |
| Disodium catecol-3,5-disulfonate salt | 1.0 g |
| Diethyleneglycol | 10.0 g |
| N-ethyl-N-β-methanesulfonamide ethyl-3-methyl-4-amino aniline sulfate | 4.5 g |
| Fluorescent brightening agent (4,4'-diaminostylbene sulfonic acid derivative) | 4.5 g |
| Potassium carbonate | 27.0 g |

DI-1

Water was added to make 1 l in total, and pH was regulated to 10.10.

| Bleach-fixer | |
|---|---|
| Ethylenediamine tetraacetic acid ferric ammonium dihydrate | 60.0 g |
| Ammonium ethylenediamine tetraacetic acid thiosulfate (an aqueous 70% solution) | 100 ml |
| Ammonium sulfite (an aqueous 40% solution) | 27.5 ml |

Water was added to make 1 l in total, and pH was regulated to 5.7 with potassium carbonate or glacial acetic acid.

| Stabilizer | |
|---|---|
| 5-chloro-2-methyl-4-isothiazoline-3-on | 0.2 g |
| 1,2-benzisothiazoline-3-on | 0.3 g |
| Ethyleneglycol | 1.0 g |
| 1-hydroxyethilidene-1,1-diphosphate | 2.0 g |
| Sodium 0-phenylphenol | 1.0 g |
| Ethylenediamine tetraacetic acid | 1.0 g |
| Ammonium hydroxide (an aqueous 20% solution) | 3.0 g |
| Fluorescent brightening agent (4,4-diaminostylbene sulfonic acid derivative) | 1.5 |

Water was added to make 1 l in total, and pH was regulated to 7.0 with sulfuric acid or potassium hydroxide.

TABLE 4

| Sample No. | Silver halide emulsion (8th layer) | Color reproduction of bluish green color: White light | Color reproduction of bluish green color: Flurorescent lamp |
|---|---|---|---|
| 205 (Comp.) | E | Slightly bluish | Rather bluish |
| 207 (Inv.) | G | Fairly faithful reproduction | Fairly faithful reproduction |

From Table 4, it can be understood that the color reproduction of bluish-green color of Sample 207 in which silver halide emulsion of the present invention is used is superior to that of Comparative sample 205 under a white light source or a fluorescent lamp as well.

Example 3

Samples 301 through 310 were prepared in the same manner as Sample 104 of Example 1, except that a supersensitizer as shown in Table 5 was further contained. Thus prepared samples were treated and evaluated in the same manner as in Example 1. Results thereof are shown in Table 5.

TABLE 5

| Sample No. | Super-sensitizer | Sensitivity (Group I) | Sensitivity (Group II) | Fog (Group I) |
|---|---|---|---|---|
| 104 | None | 100 | 70 | 0.10 |
| 301 | Compound (2) | 146 | 132 | 0.12 |
| 302 | Compound (5) | 144 | 136 | 0.10 |
| 303 | Compound (6) | 145 | 133 | 0.11 |
| 304 | Compound (8) | 145 | 134 | 0.11 |
| 305 | Compound (10) | 147 | 130 | 0.13 |
| 306 | Compound (12) | 145 | 134 | 0.11 |
| 307 | Compound (13) | 144 | 136 | 0.10 |
| 308 | Compound (14) | 146 | 132 | 0.12 |
| 309 | Compound (21) | 145 | 133 | 0.11 |
| 310 | Compound (26) | 147 | 130 | 0.13 |

As can be seen from the table, the use of the inventive supersensitizer leads to improved results in fog and latent image stability.

What is claimed is:

1. A silver halide photographic emulsion containing a monomethine-cyanine dye, a trimethine-cyanine dye, and a supersensitizer represented by the following Formula [I] or Formula [II]:

Formula [I]

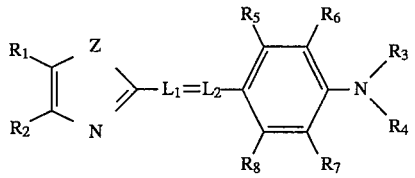

wherein $R_1$, $R_2$, $R_3$ and $R_4$ independently represent a hydrogen atom, an alkyl group, an alkenyl group, an alkynyl group, an aryl group or a heterocyclic group, and $R_1$ and $R_2$, or $R_3$ and $R_4$ may be combined with each other to form a ring; $R_5$, $R_6$, $R_7$ and $R_8$ represent a substituent; $L_1$ and $L_2$ represent a methine group; Z represents an oxygen atom, a sulfur atom, a selenium atom, a tellurium atom, —$C(R_9)(R_{10})$— or —$N(R_9)$—, in which $R_9$ and $R_{10}$ independently represent a hydrogen atom, an alkyl group, an alkenyl group, an alkynyl group, an aryl group or a heterocyclic group, $R_9$ and $R_{10}$ may be combined with each other to form a ring;

Formula [II]

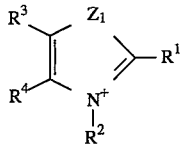

wherein $R^1$, $R^2$, $R^3$ and $R^4$ independently represent a hydrogen atom, an alkyl group, an unsubstituted vinyl group, an allyl group, an alkynyl group, an aryl group or a heterocyclic group; $Z_1$ represents an oxygen atom, a sulfur atom, a selenium atom, a tellurium atom, —$N(R_5)$— or —$C(R^6)(R^7)$—, in which $R^5$, $R^6$ and $R^7$ each have the same definition as $R^1$; $X^-$ represent an anion; and n is 0 or 1.

2. The silver halide emulsion of claim 1, wherein said monomethine-cyanine dye and said trimethine-cyanine dye are represented by the following Formula [S-I]:

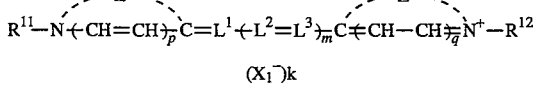

wherein $Z^1$ and $Z^2$ independently represent a group of nonmetallic atoms necessary for forming a 5-membered or 6-membered heterocyclic ring; $R^{11}$ and $R^{12}$ independently represent an alkyl group; $L^1$, $L^2$ and $L^3$ independently represent a methine group; p and q each are 0 or 1; m is 0 or 1; $X_1^-$ represents an anion; and k is 0 or 1.

3. The silver halide emulsion of claim 1, wherein said monomethine-cyanine dye and trimethine-cyanine dye are incorporated in the emulsion by a process comprising the steps of dispersing solid particles of said dyes in an aqueous medium, and introducing the resulting dispersion in the emulsion.

4. The silver halide emulsion of claim 1, wherein said monomethine-cyanine dye and said trimethine-cyanine dye are contained in a total amount of $1\times10^{-4}$ to $1\times10^{-2}$ mol per mol of silver halide.

5. The silver halide emulsion of claim 1, wherein said supersensitizer is contained in an amount of $2\times10^{-7}$ to $5\times10^{-2}$ mol per mol of silver halide.

6. The silver halide emulsion of claim 1 wherein said supersensitizer is represented by Formula [I].

7. The silver halide emulsion of claim 1 wherein said supersensitizer is represented by Formula [II].

8. A silver halide color photographic material comprising a support having thereon a blue-sensitive silver halide emulsion layer, a green-sensitive silver halide emulsion layer and a red-sensitive silver halide emulsion layer, wherein at least one of said silver halide emulsion layers contains a monomethine-cyanine dye, a trimethine-cyanine dye, and a supersensitizer represented by the following Formula [I] or Formula [II ]:

Formula [I]

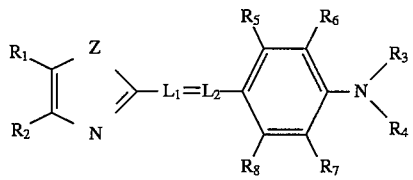

wherein $R_1$, $R_2$, $R_3$ and $R_4$ independently represent a hydrogen atom, an alkyl group, an alkenyl group, an alkynyl group, an aryl group or a heterocyclic group, and $R_1$ and $R_2$, or $R_3$ and $R_4$ may be combined with each other to form a ring; $R_5$, $R_6$, $R_7$ and $R_8$ represent a substituent; $L_1$ and $L_2$ represent a methin group; Z represents an oxygen atom, a sulfur atom, a selenium atom, a tellurium atom, —$C(R_9)(R_{10})$— or —$N(R_9)$—, in which $R_9$ and $R_{10}$ independently represent a hydrogen atom, an alkyl group, an alkenyl group, an alkynyl group, an aryl group or a heterocyclic group, $R_9$ and $R_{10}$ may be combined with each other to form a ring;

Formula [II]

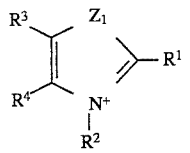

wherein $R^1$, $R^2$, $R^3$ and $R^4$ independently represent a hydrogen atom, an alkyl group, unsubstituted vinyl, allyl, an alkynyl group, an aryl group or a heterocyclic group; $Z_1$ represents an oxygen atom, a sulfur atom, a selenium atom, a tellurium atom, —N($R^5$)— or —C($R^6$)($R^7$)—, in which $R^5$, $R^6$ and $R^7$ each have the same definition as $R^1$; $X^-$ represent an anion; and n is 0 or 1.

9. The color photographic material of claim 8, wherein said monomethine-cyanine dye and said trimethine-cyanine dye are represented by the following Formula [S-I]:

Formula [S-I]

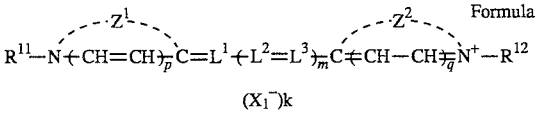

wherein $Z^1$ and $Z^2$ independently represent a group of nonmetallic atoms necessary for forming a 5-membered or 6-membered heterocyclic ring; $R^{11}$ and $R^{12}$ independently represent an alkyl group; $L^1$, $L^2$ and $L^3$ independently represent a methin group; p and q each are 0 or 1; m is 0 or 1; $X_1^-$ represents an anion; and k is 0 or 1.

10. The color photographic material of claim 8, wherein said dyes and said supersensitizer are contained in the green-sensitive silver halide emulsion layer.

11. The color photographic material of claim 8, wherein said monomethine-cyanine dye and said trimethine-cyanine dye are incorporated in the form of a dispersion of solid particles.

12. The color photographic material of claim 8 wherein said supersensitizer is represented by Formula [I].

13. The color photographic material of claim 8 wherein said supersensitizer is represented by Formula [II].

* * * * *